US005884713A

United States Patent [19]

Shinohara et al.

[11] Patent Number: 5,884,713

[45] Date of Patent: Mar. 23, 1999

[54] VIBRATION GENERATING APPARATUS

[75] Inventors: Shigeru Shinohara; Naoki Ishizaki, both of Tochigi, Japan

[73] Assignee: Komatsu Ltd., Tokyo, Japan

[21] Appl. No.: 860,741

[22] PCT Filed: Apr. 12, 1996

[86] PCT No.: PCT/JP96/01029

§ 371 Date: Jun. 12, 1997

§ 102(e) Date: Jun. 12, 1997

[87] PCT Pub. No.: WO96/32228

PCT Pub. Date: Oct. 17, 1996

[30] Foreign Application Priority Data

Apr. 14, 1995 [JP] Japan ..... 7-112682

[51] Int. Cl.[6] ..... B25D 9/04; B25D 9/18

[52] U.S. Cl. ..... 173/206; 173/207; 91/300; 91/290; 91/282

[58] Field of Search ..... 173/206, 207, 173/13, 15, 128; 91/300, 290, 282, 313, 319, 320, 235

[56] References Cited

U.S. PATENT DOCUMENTS

| | | | |
|---|---|---|---|
| 4,022,108 | 5/1977 | Juvonen | 91/319 |
| 4,230,019 | 10/1980 | Castejon Castan | 91/319 |
| 4,659,294 | 4/1987 | Barthomeuf | 91/320 |
| 4,784,228 | 11/1988 | Ito | 91/300 |
| 4,817,737 | 4/1989 | Hamada et al. | 173/207 |
| 5,038,668 | 8/1991 | Arndt et al. | 91/300 |
| 5,134,989 | 8/1992 | Akahane | 173/206 |

FOREIGN PATENT DOCUMENTS

| | | |
|---|---|---|
| 59-46682 | 3/1984 | Japan . |
| 63-156670 | 6/1988 | Japan . |
| 63-59833 | 11/1988 | Japan . |
| 2-262974 | 10/1990 | Japan . |
| 6-21923 | 6/1994 | Japan . |

*Primary Examiner*—Peter Vo
*Assistant Examiner*—A. Dexter Tugbang
*Attorney, Agent, or Firm*—Frishauf, Holtz, Goodman, Langer & Chick

[57] ABSTRACT

A vibration generating apparatus comprises a cylinder assembly (6) having a cylinder and a piston (3) slidably inserted in a cylindrical bore (2) of the cylinder for defining a first pressure receiving chamber (4) with a small pressure receiving area and a second pressure receiving chamber (5) with a large pressure receiving area. The piston (5) is selectively movable in one direction and in the other direction responsive to pressures in the pressure receiving chambers. A switching valve (9) has a first pressure chamber (13) with a large diameter, a second pressure chamber (14) with a small diameter, a pump port (10), an auxiliary port (23), a principal port (11) and a tank port (12). The switching valve (9) takes a first position under a pressure within the first pressure chamber and takes a second position under a pressure within the second pressure chamber. When the switching valve (9) is in the first position, the pump port is allowed to communicate with the auxiliary port and the principal port is allowed to communicate with the tank port. When the switching valve (9) is in the second position, the pump port is allowed to communicate with the principal port and the auxiliary port is allowed to communicate with the tank port. A servo valve (19) is responsive to a movement of the piston for establishing a communication of the first pressure chamber with a fluid pressure source (21) or a tank.

10 Claims, 29 Drawing Sheets

VIBRATION GENERATING APPARATUS

TECHNICAL FIELD

The present invention relates to a vibration generating apparatus that may be used in a breaker machine for carrying out a crushing operation, a road roller machine for carrying out a road rolling operation, and so forth.

BACKGROUND ART

As a vibration generating machine that can be used in a breaker machine, road roller machine and so forth, there has hitherto been known, for example, one that is disclosed in FIG. 1 of the drawings attached hereto.

More specifically, as shown in FIG. 1 it is seen that a unit body 1 has a piston 3 slidably inserted in a cylindrical bore 2 thereof. The said piston 3 is formed thereon with a large diameter portion 3*a*, a large diameter rod portion 3*b* and a small diameter rod portion 3*c* for defining with the correspondingly contoured surfaces of the said cylindrical bore 2 a first pressure receiving chamber 4 of a small pressure receiving area and a second pressure receiving chamber 5 of a large pressure receiving area, thus constituting a cylinder assembly 6. Further, a switching valve 9 is constructed by inserting a spool 8 slidably into a spool bore 7 of the said unit body 1 and defining a first pressure chamber 13 of a large diameter and a second pressure chamber 14 of a small diameter at both end sides of the said spool 8, respectively.

The above mentioned spool 8 is designed to establish and block a communication between a pump port 10, a principal port 11 and a tank port 12. Thus, the said spool 8 is thrusted to take a first position with a pressure fluid within the said first pressure chamber 13 of the large diameter to establish a communication between the said principal port 11 and the said tank port 12 and is thrusted to take a second position with a pressure fluid within the said second pressure chamber 14 of the small diameter to establish a communication between the said pump port 10 and the said principal port 11.

A servo valve 19 has a construction in which the above mentioned tank port 12 is normally allowed to communicate with a drain port 15 that is formed in the said cylindrical bore 2, the said first pressure chamber 13 is normally allowed to communicate with an auxiliary port 16 that is formed in the said cylindrical bore 2, and the said auxiliary port 16 is designed to establish and block, via a switching spool 17 that is integral with the said piston 3, a communication between the said drain port 15 and a first port 18. And, the said principal port 11 is allowed to communicate with a second port 20 whereas the said first port 18 and the said pump port 10 are supplied with a pressure fluid that is discharged from a hydraulic pump 21.

The above mentioned vibration generating apparatus is diagrammatically represented in FIG. 2 of the drawings attached hereto, in which the said first port 18 is shown as serving for both the said servo valve 19 and the said first pressure receiving chamber 4.

The above mentioned vibration generating apparatus will operate as set forth below.

When the said piston 3 is held at its neutral position as shown in FIGS. 1 and 2, the said spool 17 will act to block the said drain port 15, the said auxiliary port 16 and the said first port 18 so that the pressure fluid may be sealed within the said first pressure chamber 13. Then, the spool 8 (i.e. in the switching valve 9) will take a first position A to allow the said principal port 11 to communicate with the said tank port 12.

This will cause the said piston 3 to be moved in one direction (as shown by the arrow a) with the pressure fluid within the said first pressure receiving chamber 4. When it is so thrusted to take a position as shown in FIGS. 3 and 4, the said auxiliary port 16 will be allowed to communicate via a small diameter portion 17*a* of the said switching spool 17 with the said drain port 15 so that the pressure fluid may flow out of the said first pressure chamber 13 into a tank 22. The said spool 8 will then be thrusted to take a leftward position, i.e., a second position B as shown in FIG. 2, with the pressure within the said second pressure chamber 14 to establish a communication between the said pump port 10 and the said principal port 11.

This will cause the said second pressure receiving chamber 5 to be supplied with a pressure fluid and will thus cause the said piston 3 to be moved in the other direction (as shown by the arrow b) due to a difference in pressure based upon a difference in pressure receiving area.

When the said piston 3 is then thrusted to reach a position as shown in FIGS. 5 and 6, a communication between the said auxiliary port 16 and the said first port 18 will be established via the said large diameter rod portion 3*b* of the piston 3 to supply the said first pressure chamber 13 with a pressure fluid until the said spool 8 is thrusted to reach the said first position A shown in FIGS. 1 and 2 due to a difference in pressure based upon a difference in pressure receiving area so that the said piston 3 may be moved in the said one direction (shown by the arrow a). Such a series of operations will be repeated with the above mentioned vibration generating apparatus.

With such a vibration generating apparatus, it has been found, however, that when a said piston 3 is switched to move from a stroke end position in one direction into the other direction, a state will develop in which a pressure fluid is sealed in a said first pressure chamber 13. Thus, if the said piston 3 is moved slightly from a stroke end position in one direction as shown in FIGS. 1 and 2 into the other direction (as shown by the arrow b), a communication between a said auxiliary port 16 and a said drain port 15 will be blocked to bring about the the state in which the pressure fluid is sealed in the said first pressure chamber 13.

This will cause a pressure fluid in a said first pressure receiving chamber 4 to be leaked through a gap between a said cylindrical bore 2 and a said switching spool 19 to flow into the said first pressure chamber 13, and can, with a said spool 8 that may possibly be moved towards a said first position A, possibly result in a false operation.

More specifically, if the said spool 8 is allowed to reach the said first position A while the said piston 3 is being moved in the other direction, a said second pressure receiving chamber 5 will be caused to communicate with a said tank 22 so that the said piston 3 may be moved in the said one direction, i.e., reversely. Since this can result in a false operation, it may no longer be possible to ensure a regular reciprocating movement of the said piston 3.

With the above mentioned problems taken into account, it is, accordingly, an object of the present invention to provide a vibration generating apparatus which, without a piston suffering from a false operation, enables a reciprocating movement thereof to be carried out without fail.

SUMMARY OF THE INVENTION

In order to achieve the object mentioned above, there is provided in accordance with the present invention, in a first general aspect thereof, a vibration generating apparatus, which comprises:

a cylinder assembly having a cylinder and a piston slidably inserted in a cylindrical bore of the said cylinder for defining a first pressure receiving chamber with a small pressure receiving area and a second pressure receiving chamber with a large pressure receiving area, the said piston being movable in one direction with a pressure fluid within the said first pressure receiving chamber and in the other direction under a difference in pressure based on a difference in pressure receiving area between the said first pressure receiving chamber and the said second pressure receiving chamber;

a switching valve having a first pressure chamber with a large diameter, a second pressure chamber with a small diameter, a pump port, an auxiliary port, a principal port and a tank port and being adapted to take a first position under a pressure within the said first pressure chamber and to take a second position under a pressure within the said second pressure chamber, the said first position being taken to allow the said pump port to communicate with the said auxiliary port and to allow the said principal port to communicate with the said tank port, the said second position being taken to allow the said pump port to communicate with the said principal port and to allow the said auxiliary port to communicate with the said tank port; and a servo valve responsive to a movement of the said piston for establishing a communication of the said pressure chamber with a fluid pressure source or a tank, each of the said first pressure receiving chamber and the said second pressure chamber having a communication with the said fluid pressure source, the said second pressure receiving chamber having a communication with the said principal port.

According to the construction mentioned in the preceding paragraph, it can be seen that a movement of the said piston in the said cylinder assembly will cause the said first pressure chamber in the switching valve to communicate with the said fluid pressure source and the said tank alternately. Accordingly, when the said switching valve takes the said second position to supply the said second pressure chamber with the pressure fluid so that the said piston may be moved in the said other direction, it can be seen that the said first pressure chamber will be allowed to communicate with a drain outlet; therefore, there will be no pressure generated in the said first pressure chamber.

Accordingly, there may be no possibility for the said switching valve to take the said first position while the said piston is being moved in the said other direction. Hence, it ensues that the said piston will be moved without suffering from any false operation whatsoever.

The present invention also provides, in a second general aspect thereof, a vibration generating apparatus, which comprises:

a cylinder assembly having a cylinder and a piston slidably inserted in a cylindrical bore of the said cylinder for defining a first pressure receiving chamber with a small pressure receiving area, a second pressure receiving chamber with a large pressure receiving area, a first buffer chamber and a second buffer chamber, the said piston being movable in one direction with a pressure fluid within said first pressure receiving chamber and in the other direction under a difference in pressure based on a difference in pressure receiving area between the said first pressure receiving chamber and the said second pressure receiving chamber, the said second buffer chamber being responsive to a movement of the said piston in the said one direction for reducing its volume, the said first buffer chamber being responsive to a movement of the said piston in the said other direction for reducing its volume;

a switching valve having a first pressure chamber with a large diameter, a second pressure chamber with a small diameter, a pump port, an auxiliary port, a principal port and a tank port and being adapted to take a first position under a pressure within the said first pressure chamber and to take a second position under a pressure within the said second pressure chamber, the said first position being taken to allow the said pump port to communicate with the said auxiliary port and to allow the said principal port to communicate with the said tank port, the said second position being taken to allow the said pump port to communicate with the said principal port and to allow the said auxiliary port to communicate with the said tank port; and a servo valve responsive to a movement of the said piston for establishing a communication of the said pressure chamber with a fluid pressure source or a tank, the said servo valve being also responsive to a movement of the said piston in the said one direction for permitting the said first buffer chamber to communicate with the said tank while reducing an area of communication between the said second buffer chamber and the said tank in a sequence and responsive to a movement of the said piston in the said other direction for permitting the said second buffer chamber to communicate with the said tank while reducing an area of communication between the said first buffer chamber and the said tank in a sequence, each of the said first pressure receiving chamber and the said second pressure chamber having a communication with the said fluid pressure source, the said second pressure receiving chamber having a communication with the said principal port, the said apparatus being adapted to block a communication between the said second buffer chamber and the said tank or a communication between the said first buffer chamber and the said tank, prior to an arrival of the said piston at a stroke end in the said one direction or in the said other direction.

According to the construction mentioned in the preceding paragraph, it can be seen that while the said piston is being moved in the said one or the said other direction, its velocity of movement will be slowed down sequentially and since it can, prior to its arrival at a stroke end, be stopped with the pressure fluid within the said second buffer chamber or the said first buffer chamber, there will be no large sound of impact generated and the said piston may be moved in the said one and the said other directions alternately without fail even if no chisel is provided.

It can also be seen that the said piston may suffer from no false operation whatsoever since it is by a movement thereof which the said servo valve or said switching valve is switched.

It can further be seen that while the said piston is being moved in the said one or the said other direction, its velocity of movement will be slowed down in a sequence; hence there could be no large sound of impact generated.

The present invention also provides, in a third general aspect thereof, a vibration generating apparatus, which comprises:

a cylinder assembly having a cylinder and a piston slidably inserted in a cylindrical bore of the said cylinder for defining a first pressure receiving chamber with a small pressure receiving area, a second pressure receiving chamber with a large pressure receiving area and a first buffer chamber, the said second pressure receiving chamber also serving as a second buffer chamber, the said piston being movable in one direction with a pressure fluid within the said first pressure receiving chamber and in the other direction under a difference in pressure based on a difference in pressure receiving area between the said first pressure receiving chamber and the said second pressure receiving chamber, the said second pressure receiving chamber being responsive to a movement of the said piston in the said one direction for reducing its volume, the said first buffer chamber being responsive to a movement of the said piston in the said other direction for reducing its volume;

a switching valve having a first pressure chamber with a large diameter, a second pressure chamber with a small diameter, a pump port, an auxiliary port, a principal port and a tank port and being adapted to take a first position under a pressure within the said first pressure chamber and to take a second position under a pressure within the said second pressure chamber, the said first position being taken to allow the said pump port to communicate with the said auxiliary port and to allow the said principal port to communicate with the said tank port, the said second position being taken to allow the said pump port to communicate with the said principal port and to allow the said auxiliary port to communicate with the said tank port; and a servo valve responsive to a movement of the said piston for establishing a communication of the said pressure chamber with a fluid pressure source or a tank, the said servo valve being also responsive to a movement of the said piston in the said one direction for permitting the said first buffer chamber to communicate with the said tank while reducing an area of communication between the said second buffer chamber and the said tank in a sequence and responsive to a movement of the said piston in the said other direction for permitting the said second buffer chamber to communicate with the said tank while reducing an area of communication between the said first buffer chamber and the said tank in a sequence, each of the said first pressure receiving chamber and the said second pressure chamber having a communication with the said fluid pressure source, the said apparatus being adapted to block a communication between the said second pressure receiving chamber and the said tank or a communication between the said first buffer chamber and the said tank, prior to an arrival of the said piston at a stroke end in the said one direction or in the said other direction.

The present invention further provides, in a fourth general aspect thereof, a vibration generating apparatus, which comprises:

a cylinder assembly having a cylinder and a piston slidably inserted in a cylindrical bore of the said cylinder for defining a first pressure receiving chamber with a small pressure receiving area, a second pressure receiving chamber with a large pressure receiving area, a first buffer chamber and a second buffer chamber, the said piston being movable in one direction with a pressure fluid within the said first pressure receiving chamber and in the other direction under a difference in pressure based on a difference in pressure receiving area between the said first pressure receiving chamber and the said second pressure receiving chamber, the said second buffer chamber being responsive to a movement of the said piston in the said one direction for reducing its volume, the said first buffer chamber being responsive to a movement of the said piston in the said other direction for reducing its volume;

a switching valve having a first pressure chamber with a large diameter, a second pressure chamber with a small diameter, a pump port, an auxiliary port, a principal port and a tank port and being adapted to take a first position under a pressure within the said first pressure chamber and to take a second position under a pressure within the said second pressure chamber, the said first position being taken to allow the said pump port to communicate with the said auxiliary port and to allow the said principal port to communicate with the said tank port, the said second position being taken to allow the said pump port to communicate with the said principal port and to allow the said auxiliary port to communicate with the said tank port;

a servo valve responsive to a movement of the said piston for establishing a communication of the said pressure chamber with a fluid pressure source or a tank, the said servo valve being also responsive to a movement of the said piston in the said one direction for permitting the said first buffer chamber to communicate with the said tank while reducing an area of communication between the said second buffer chamber and the said tank in a sequence and responsive to a movement of the said piston in the said other direction for permitting the said second buffer chamber to communicate with the said tank while reducing an area of communication between the said first buffer chamber and the said tank in a sequence; and a volume switching means for increasing and decreasing the volume of the said second pressure receiving chamber, each of the said first pressure receiving chamber and the said second pressure chamber having a communication with the said fluid pressure source, the said second pressure receiving chamber having a communication with the said principal port, the said apparatus being adapted to block a communication between the said second buffer chamber and the said tank or a communication between the said first buffer chamber and the said tank, prior to an arrival of the said piston at a stroke end in the said one direction or in the said other direction.

According to the constructions mentioned in the preceding paragraphs, it can be seen that if the said second pressure receiving chamber is reduced in volume, it will be enabled for the said piston to be moved at an increased velocity, thus making an impact by a chisel appropriate and that if the said pressure receiving chamber is increased in volume, a hydraulic pump for supplying the said second pressure chamber with the pressure fluid will be increased in its pressure change to enable a high pressure and a low pressure to be generated alternately. Thus, using such a high pressure and such a low pressure, it will become possible to vibrate a bucket cylinder or the like.

In the construction just mentioned above, it is preferred that the said volume switching means should comprise an auxiliary second pressure receiving chamber disposed in the said cylinder assembly, and a volume switching valve for permitting the said auxiliary second pressure receiving chamber to communicate with the said second buffer chamber or the said second pressure chamber.

Further, in each of the construction just mentioned above and the constructions previously mentioned, it is possible that the said cylinder assembly, the said switching valve and the said servo valve may be incorporated in a unit body, and the said unit body may have a handling instrument detachably attached thereto in opposition to the said piston so that the said chisel may be impacted when the said piston is moved in the said other direction.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention but to facilitate an explanation and understanding thereof.

In the accompanying drawings.

BEST MODES FOR CARRYING OUT THE INVENTION

Figure 1:
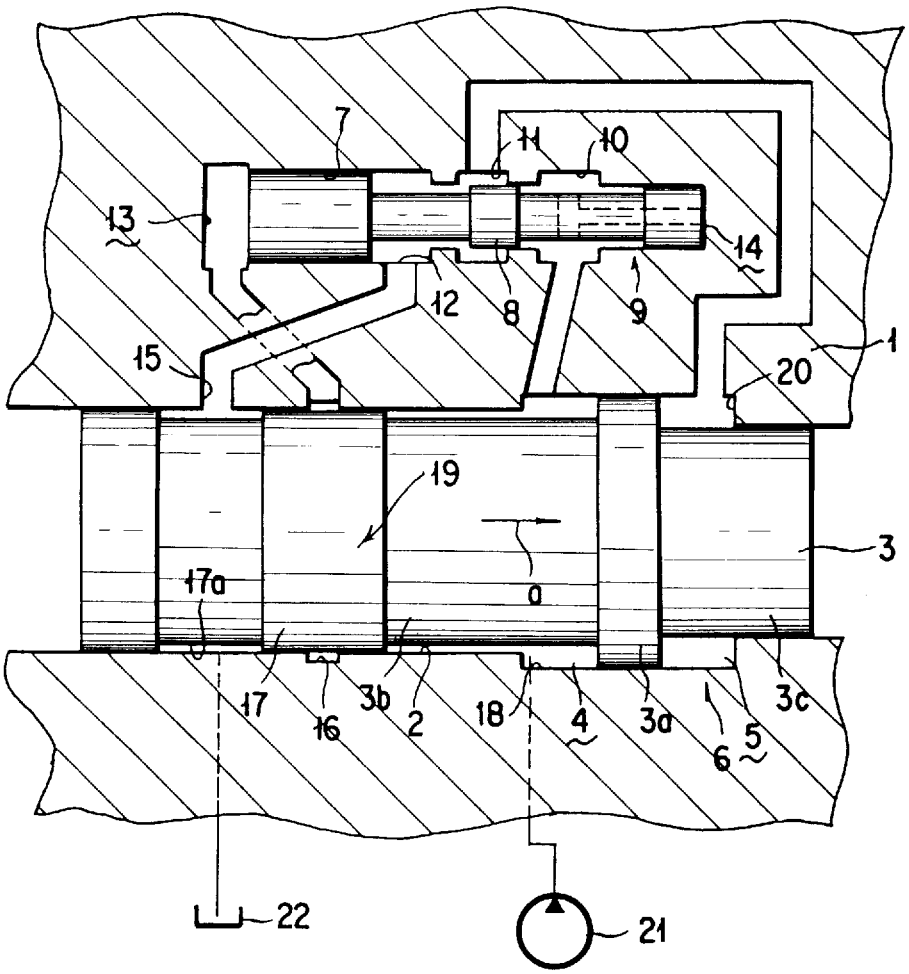
FIG. 1 is a cross sectional view that shows a vibration generating apparatus in the prior art.
Figure 2:
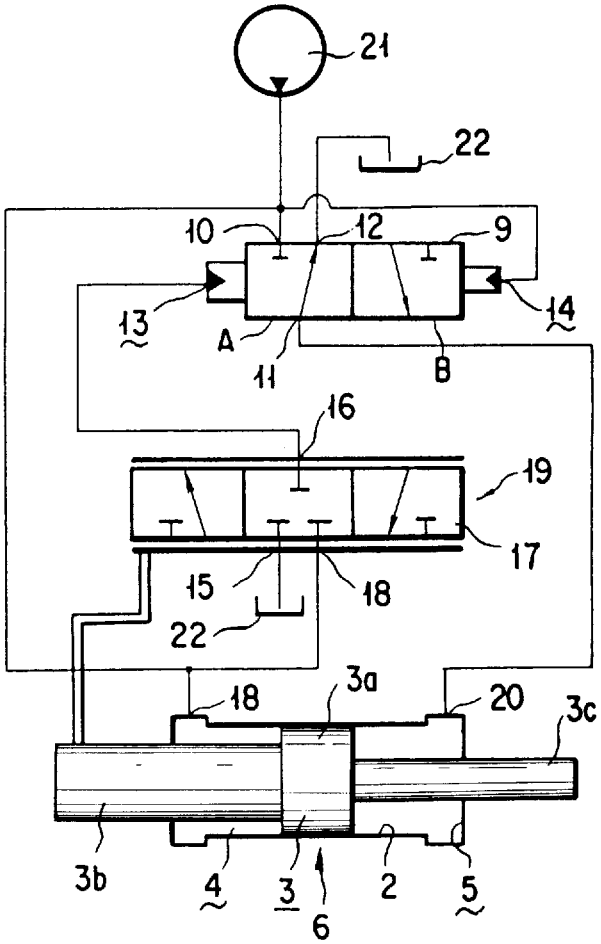
FIG. 2 is an explanatory view that diagrammatically shows the above mentioned vibration generating apparatus in the prior art.
Figure 3:
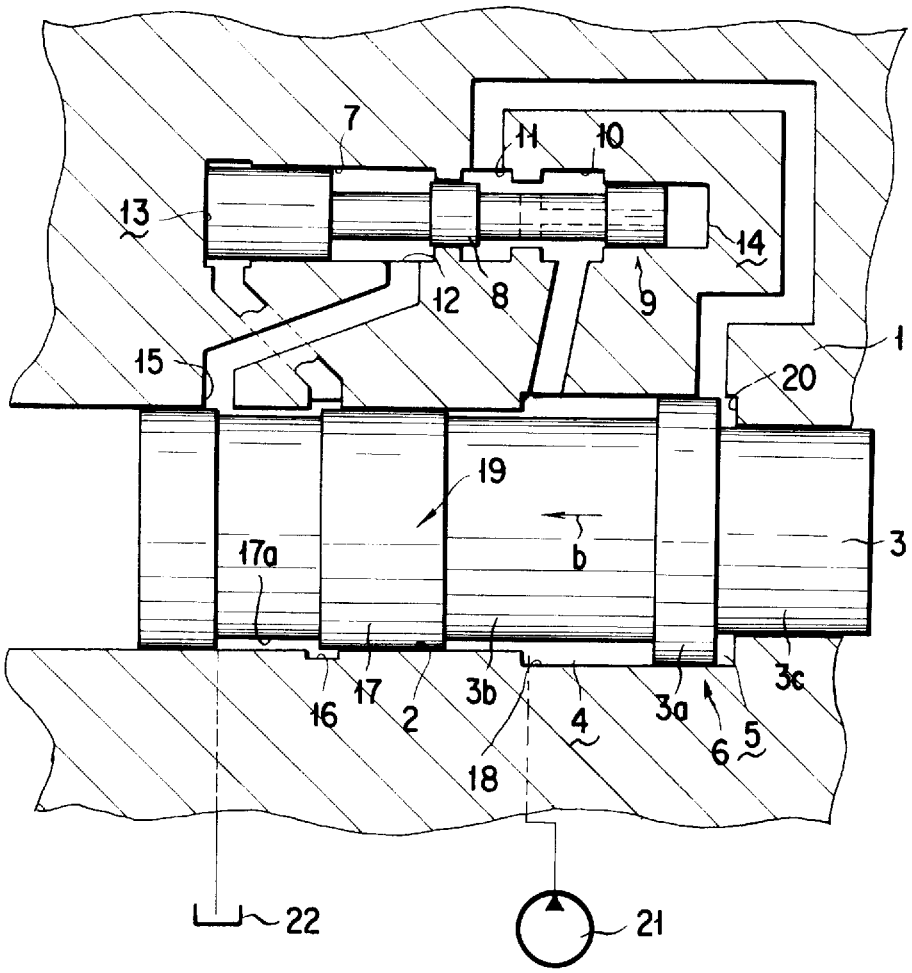
FIG. 3 is an explanatory view that illustrates an operation of the above mentioned vibration generating apparatus in the prior art.
Figure 4:
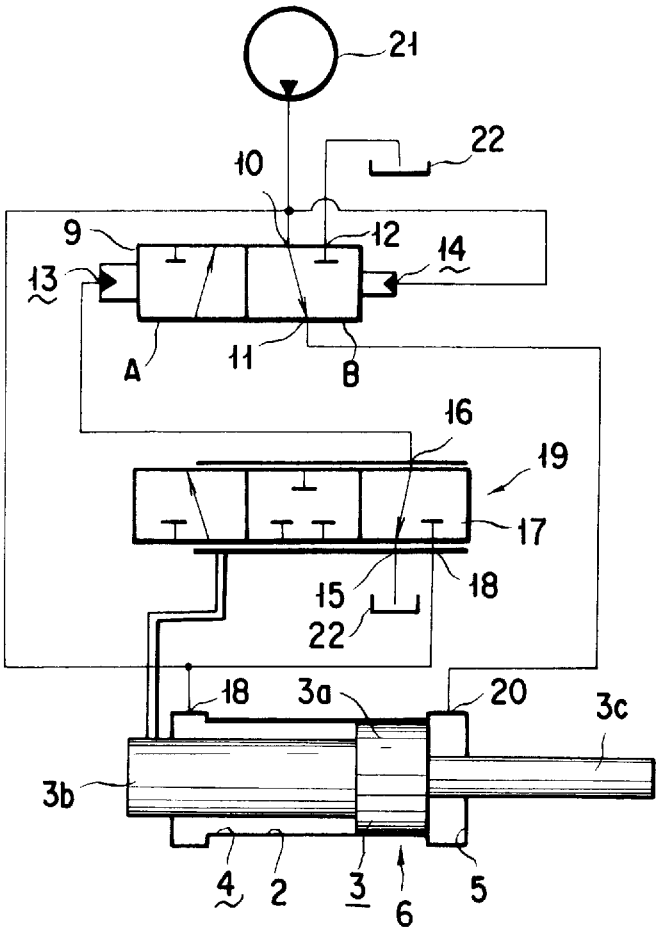
FIG. 4 is an explanatory view that illustrates an operation of the above mentioned vibration generating apparatus in the prior art.
Figure 5:
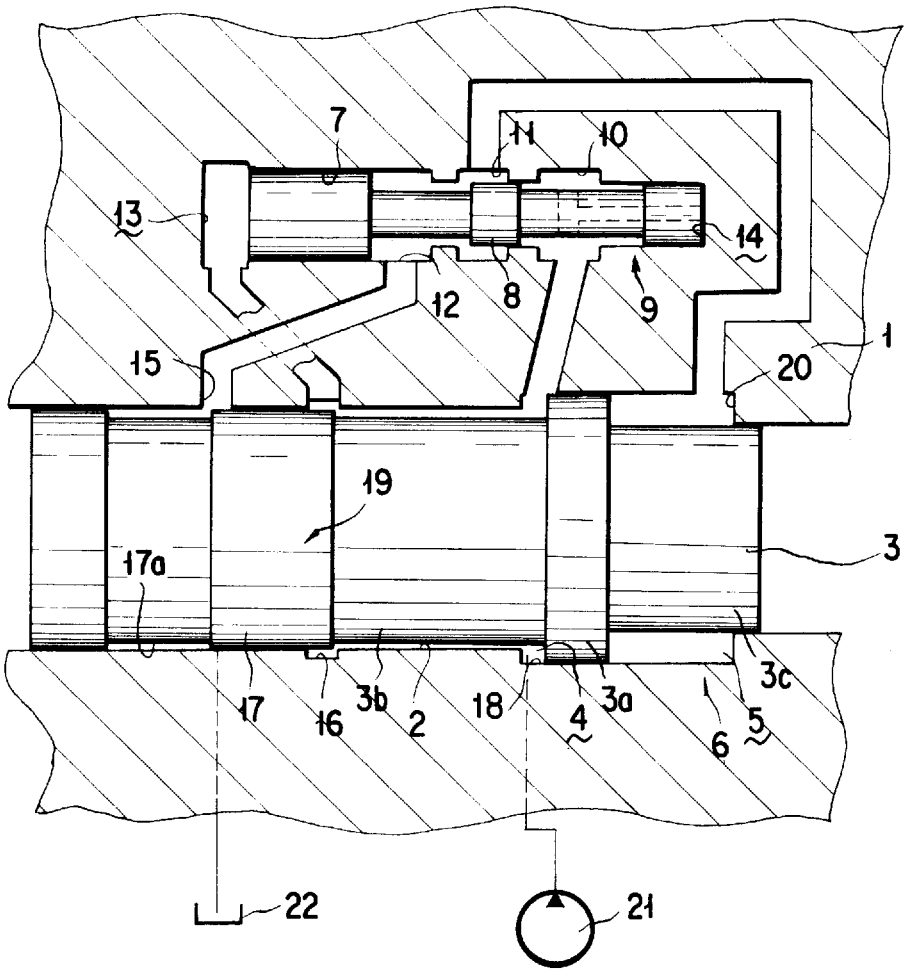
FIG. 5 is an explanatory view that illustrates an operation of the above mentioned vibration generating apparatus in the prior art.
Figure 6:
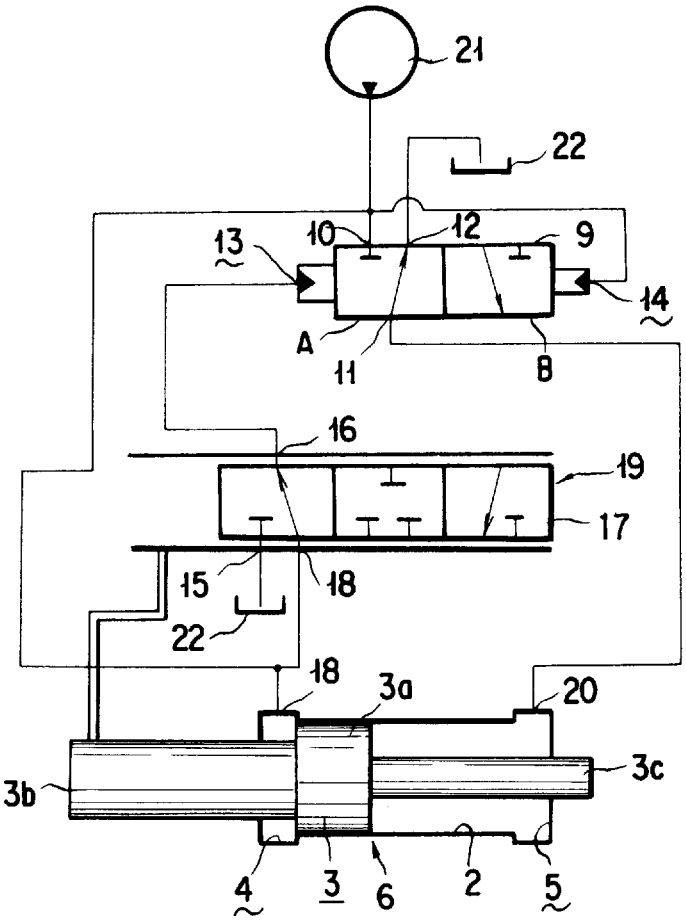
FIG. 6 is an explanatory view that illustrates an operation of the above mentioned vibration generating apparatus in the prior art.

Hereinafter, suitable embodiments of the present invention with respect to a vibration generating apparatus for a bucket type excavating machine will be set forth with reference to the accompanying drawings hereof.

An explanation will now be given with respect to a first embodiment with reference to FIGS. 7 and 8. It should be noted in this connection that the same components as in the prior art are designated by the same reference numerals.

Figure 7:
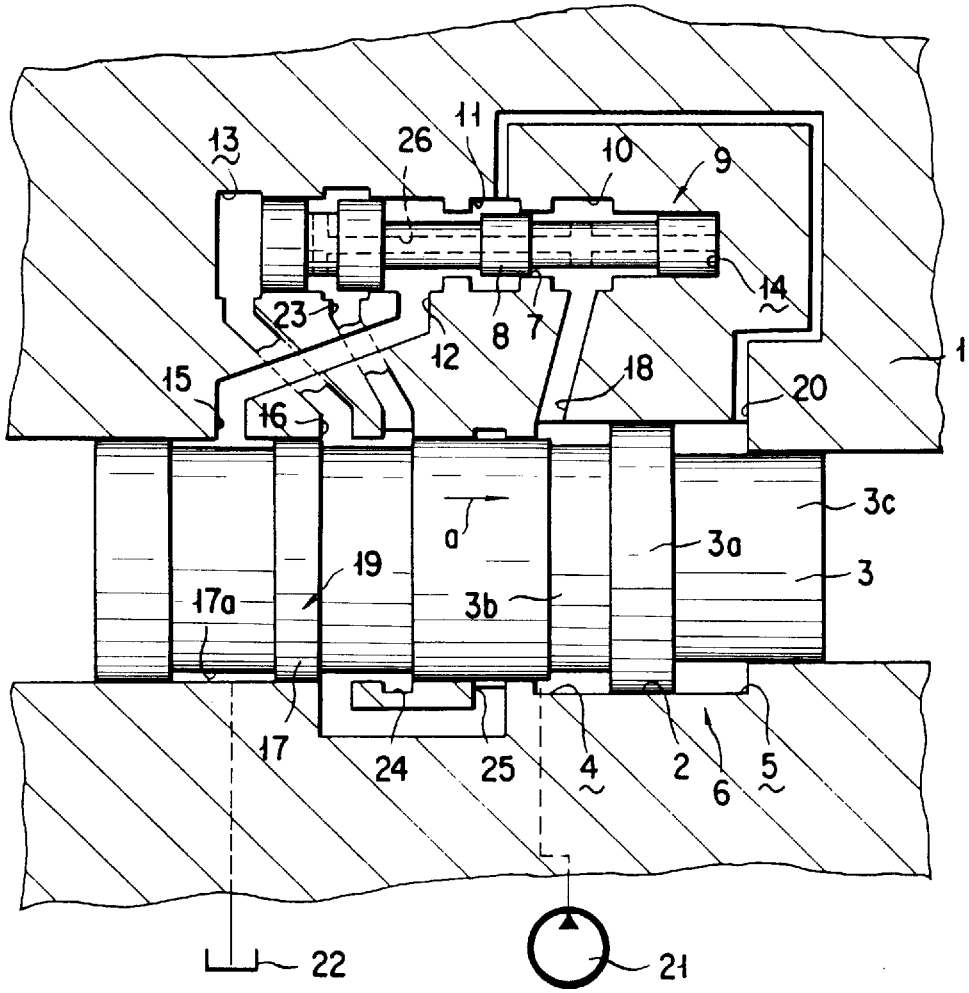
FIG. 7 is a cross sectional view that shows a first embodiment of the vibration generating apparatus according to the present invention.

As shown in FIG. 7, a said spool bore 7 is formed with an auxiliary port 23, a said cylindrical bore 2 is formed with a first and a second communication port 24 and 25 and a said spool 8 is formed with an axial bore 26 so that a pressure fluid having flown into a said pump port 10 may be allowed to flow through the said axial bore 26 of the spool 8 into the said auxiliary port 23 and from the said auxiliary port 23 via the said first communication port 24 and a said auxiliary port 16 into a said first pressure chamber 13.

Figure 8:
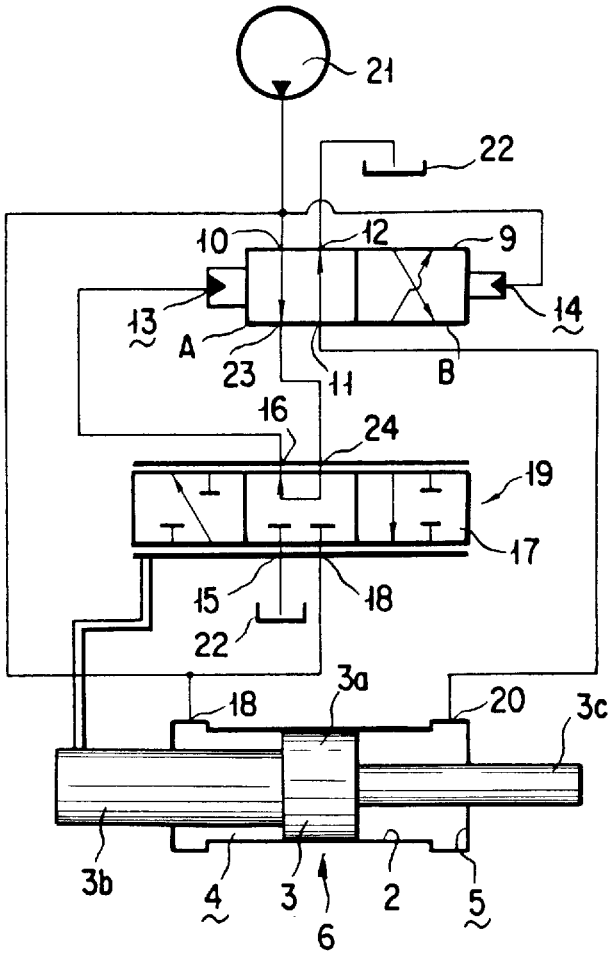
FIG. 8 is an explanatory view that diagrammatically shows the above mentioned first embodiment of the present invention.

This vibration generating apparatus (the first embodiment) can be represented in a circuit diagram as shown in FIG. 8, in which a switching valve 9 is constituted by a 4-port and 2-position valve and when in a said second position B has the said auxiliary port 23 allowed in a communication with a said tank port 12.

An explanation will next be given with respect to the operation of this first embodiment of the present invention.

When a said piston 3 is held in its neutral position as shown in FIG. 7, it can be seen that the said first communication port 24 will be allowed to communicate with the said auxiliary port 16 so that the pressure fluid from the said pump port 10 may flow through the said axial bore 26, the said auxiliary port 23, the said first communication port 24 and the said auxiliary port 16 and then be supplied into the said first pressure chamber 13 to thrust the said spool 8 to assume its first position A. As a result, a pressure fluid from a said second pressure receiving chamber 5 will flow through a said second port 20, a said principal port 11 and a tank port 12 and then be discharged through a said drain port 15 to allow the said piston 3 to be thrusted in one direction (as shown by the arrow a) with a pressure fluid in a said first pressure receiving chamber 4.

Figure 9:
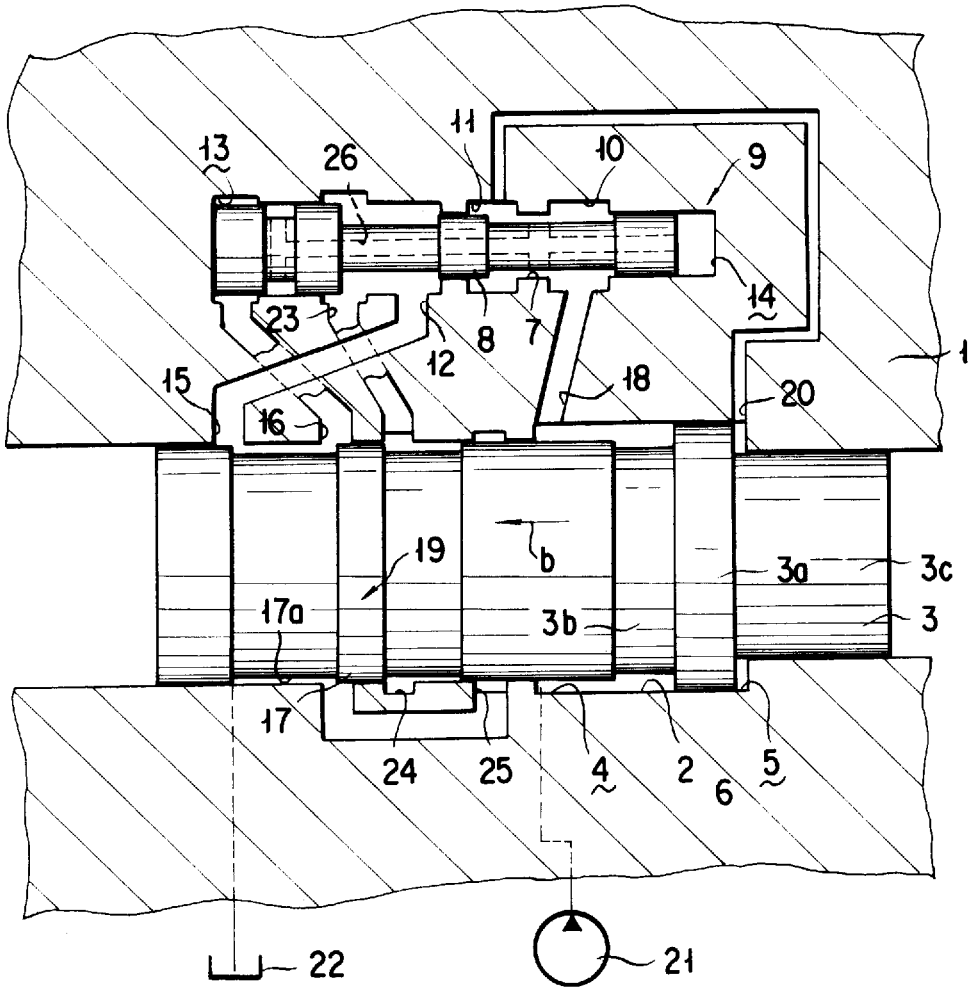
FIG. 9 is an explanatory view that illustrates an operation of the above mentioned first embodiment of the present invention.
Figure 10:
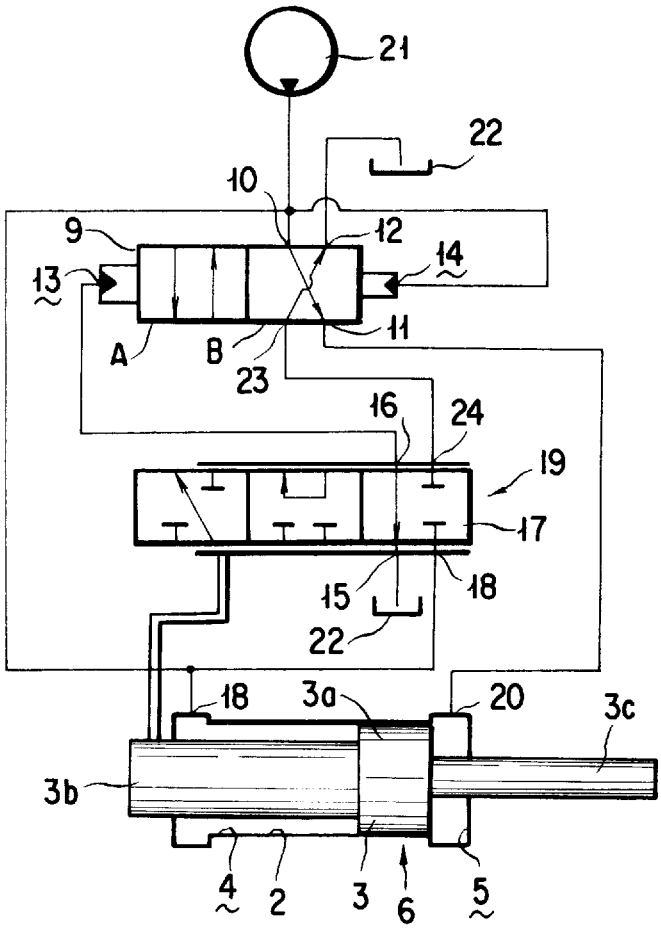
FIG. 10 is an explanatory view that illustrates an operation of the above mentioned first embodiment of the present invention.

When the said piston 3 is moved in one direction to a stroke end as shown in FIGS. 9 and 10, the said first communication port 24 will be blocked and the said auxiliary port 16 will be allowed to communicate with the said drain port 15 so that the pressure fluid may flow from the said first pressure chamber 13 into a said tank 22 to allow the said spool 8 to be thrusted with a pressure fluid within a said second pressure chamber 14 to assume its second position B. Then, the pressure fluid will flow from the said pump port 10 through the said principal port 11 and the said second port 20 into the said second pressure receiving chamber 5 to allow the said piston 3 to be moved with the pressure fluid therein in the other direction (as represented by the arrow b).

Figure 11:
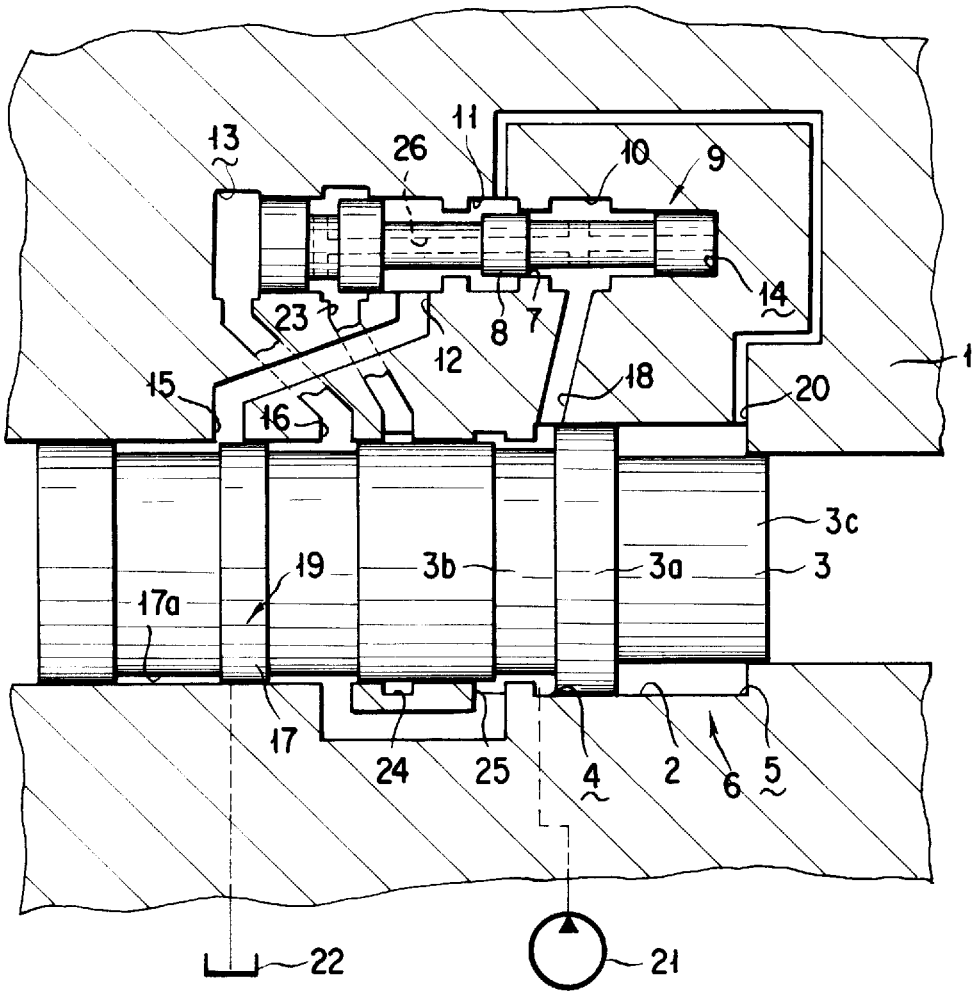
FIG. 11 is an explanatory view that illustrates an operation of the above mentioned first embodiment of the present invention.
Figure 12:
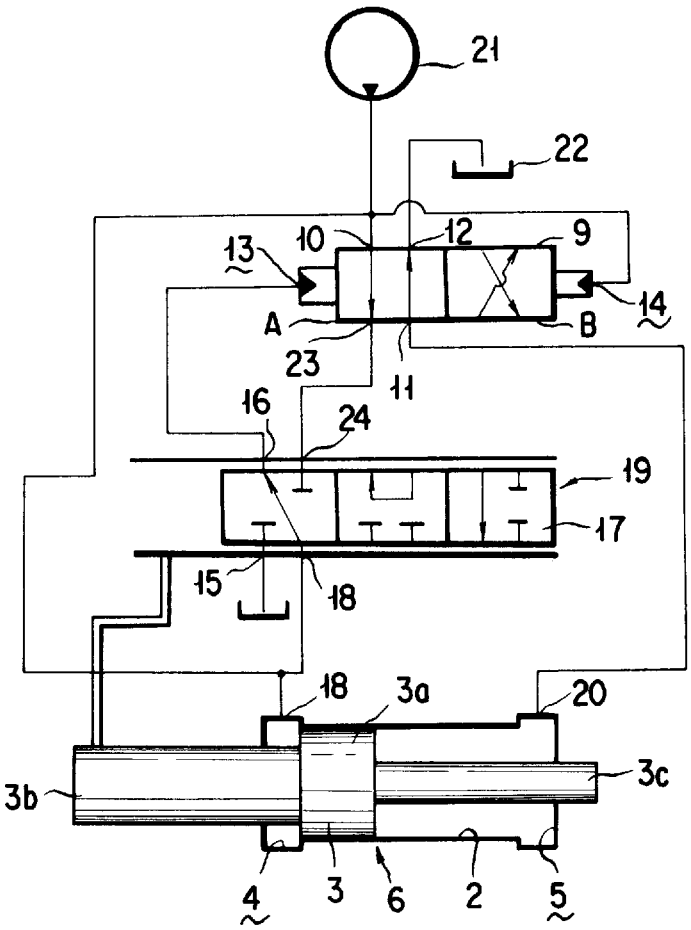
FIG. 12 is an explanatory view that illustrates an operation of the above mentioned first embodiment of the present invention.

When the said piston 3 is moved in the said other direction to a stroke end as shown in FIGS. 11 and 12, a communication will be established between a said first port 18 and the said second communication port 25 so that the pressure fluid may flow from the said auxiliary port 16 into the said first pressure chamber 13 to allow the said spool 8 to be thrusted with the pressure fluid therein to resume its first position A, thus displacing the said piston in the said one direction again. Then, the operation will be repetitively carried out thereafter.

In this manner, with the said second pressure chamber 14 in the said switching valve 9 constantly allowed to communicate with the said pump port 10 and with the said first pressure receiving chamber 13 therein allowed to communicate with the said pump port 10 and the said drain port 15 alternately, there will be no false operation of the said spool 8 and there will be a reciprocating movement of the said piston 3 without fail.

More specifically, the said first pressure chamber 13 will remain communicating with the said tank until the said piston 3 that has been at a stroke end position in the said one direction is switched and moves to reach a predetermined movement position in the said other direction (represented by the arrow b) so that there may be no pressure generated in the said first pressure chamber 13 if there may be a leakage of the pressure fluid within the said first pressure chamber 4 through an interstice between the said cylindrical bore 2 and the said piston 3. And, if the said piston 3 is moved in the said other direction by more than the predetermined distance to block the said auxiliary port 16, the pressure fluid if leaked through the said interstice will flow through the said second communication port 25, the said first communication port 24, the said auxiliary port 23, the said tank port 12 and the said drain port 15 into the said tank 22 so that there may be no pressure generated in the said first pressure chamber 13 and there may then be no movement of the said spool 8 in the said switching valve 9 to its first position A.

Figure 13:
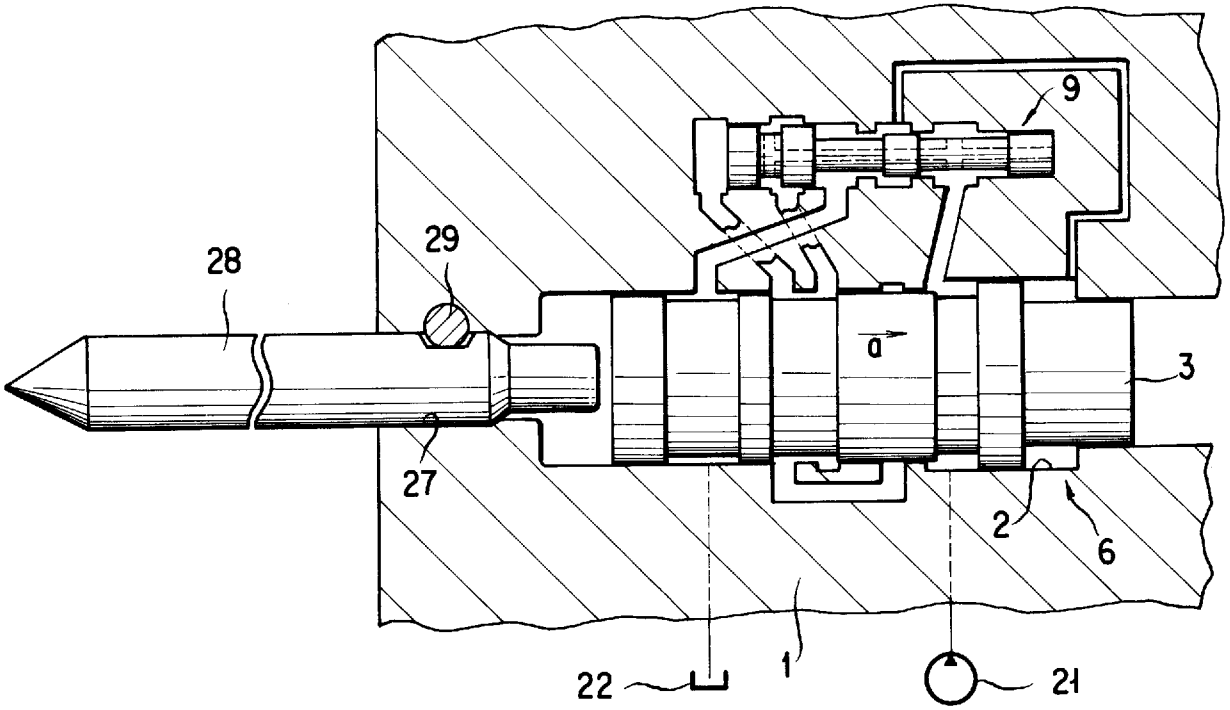
FIG. 13 is a cross sectional view that shows a state in which a chisel is provided in the above mentioned first embodiment of the present invention.

It should also be noted here that the above mentioned unit body 1 as shown in FIG. 13 is formed with a bore 27 coaxially and contiguously with the said cylindrical bore 2 and a handling instrument such as a chisel 28 is inserted into the said bore 27 with a pin 29 provided to prevent the said chisel 28 from coming off. This arrangement is provided to carry out a crushing operation with the said chisel 28 by striking the same and permitting it to be vibrated with the said piston 3.

It can also be seen that if instead of the above mentioned chisel 28, a rolling plate (not shown) is inserted into the said instrument accepting bore 27 with the said pin 29 provided to prevent the said rolling plate from coming off, a road rolling operation may be carried out with the said rolling plate.

An explanation will now be given with respect to a second embodiment of the present invention.

Figure 14:
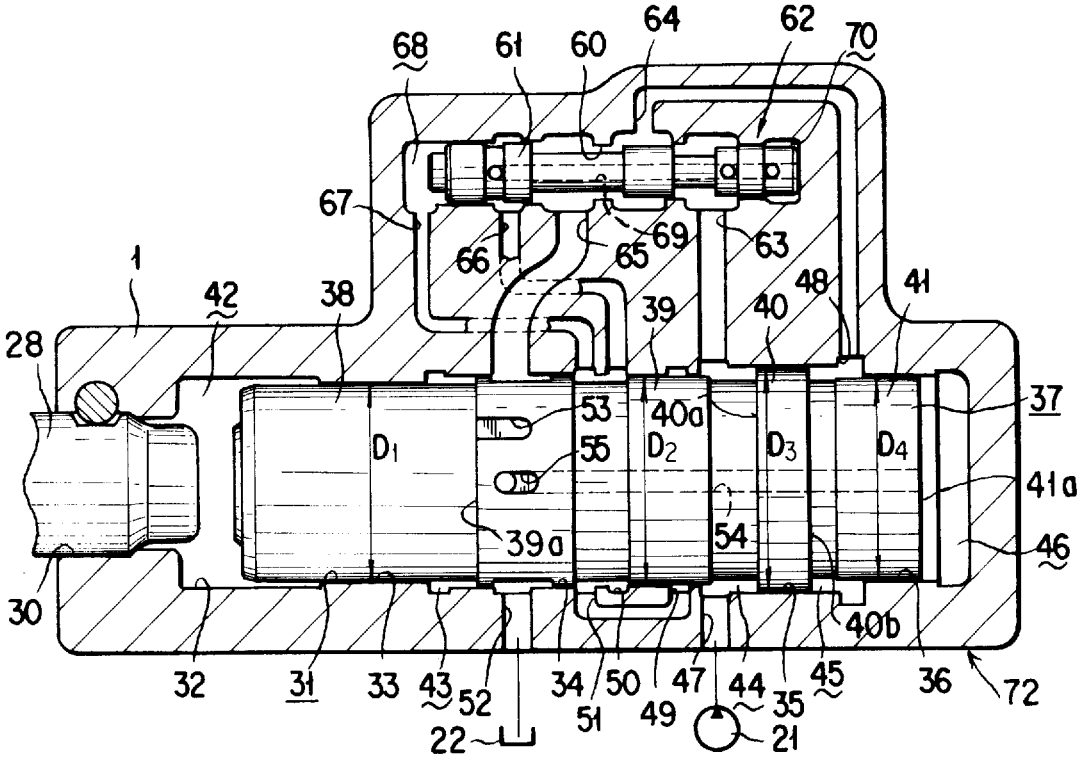
FIG. 14 is a cross sectional view that shows a second embodiment of the vibration generating apparatus according to the present invention.

As shown in FIG. 14, the said unit body 1 is formed with a handling instrument accepting bore 30 coaxially and contiguously with a cylindrical bore 31, which is formed by a stepped bore having a first bore 32, a second bore 33, a third bore 34, a fourth bore 35 and a fifth bore 36 which in their axial direction are different in diameter and contiguous from one to another successively. Assuming that the said second bore 33 has a diameter of D1, the said third bore 34 has a diameter of D2, the said fourth bore 35 has a diameter D3 and the said fifth bore 36 has a diameter of D4, the relationship: $D1=D4<D2<D3$ here applies with the said second bore 33 being identical in diameter to the said fifth bore 36.

The above mentioned cylindrical bore 31 has a piston 37 slidably inserted therein. The said piston 37 is of a stepped configuration having a first axial portion 38 that is identical in diameter to the said second bore 33, a second axial portion 39 that is identical in diameter to the said third bore 34, a third axial portion 40 that is identical in diameter to the said fourth bore 35 and a fourth axial portion that is identical in diameter to the said fifth bore 36. And, a first chamber 42 is defined by the said axial portion 38 and the said first bore 32, a first buffer chamber 43 is defined by the said first axial portion 38, one end surface 39*a* of the said second axial portion 39 and the said third bore 34, a first pressure receiving chamber 44 is defined by the said second axial portion 39, one end surface 40*a* of the said third axial portion 40 and the said fourth bore 35, a second pressure receiving chamber 45 is defined by the other end surface 40*b* of the said third axial portion 40, the fourth axial portion 41 and the said fourth bore 35, and a second buffer chamber 46 is defined by one end surface 41*a* of the said fourth axial portion 41 and the said fifth bore 36. The said first pressure receiving chamber 44 is smaller in pressure receiving area than the said second pressure receiving chamber 45.

The above mentioned unit body 1 is formed therein with a first port 47 that is opening to the said first pressure receiving chamber 44, a second port 48 that is opening to the said second pressure receiving chamber 45, a third, a fourth and a fifth port 49, 50 and 51, and a drain port 52.

The above mentioned piston 37 is formed with a first recess 53 that is designed to establish and block a communication between the said first buffer chamber 43 and the said drain port 52, and an axial bore 54 and a second recess 55 that are designed to establish and block a communication between the said second buffer chamber 46 and the said drain port 52.

The above mentioned unit body 1 is formed therein with a spool bore 60 which has a spool 61 slidably inserted therein to constitute a switching valve 62. The said spool 60 is formed with a sixth, a seventh, a eighth, a ninth and a tenth port 63, 64, 65, 66 and 67 with the said sixth port 63 communicating with the said first port 47, the said seventh port 64 communicating with the said second port 48, the said eighth port 65 communicating with the said drain port 52, the said ninth port 66 communicating with the said fourth port 50, and the said tenth port 67 communicating with the said fifth port 51.

The above mentioned spool 61 is adapted to be thrusted in one direction with a pressure fluid within a first pressure chamber 68 to establish a communication between the said seventh port 64 and the said eighth port 65 and to assume its first position for permitting the said sixth port 63 and the said ninth port 66 to communicate with each other via an axial bore 69. The said spool 61 is also adapted to be thrusted in the other direction with a pressure fluid within a second pressure chamber 70 to establish a communication between the said sixth port 63 and the said seventh port 64 and to assume its second position for permitting the said eighth port 65 and the said ninth port 66 to communicate with each other. The said first pressure chamber 68 is sized to be smaller in pressure receiving area than the said second pressure chamber 70.

Figure 15:
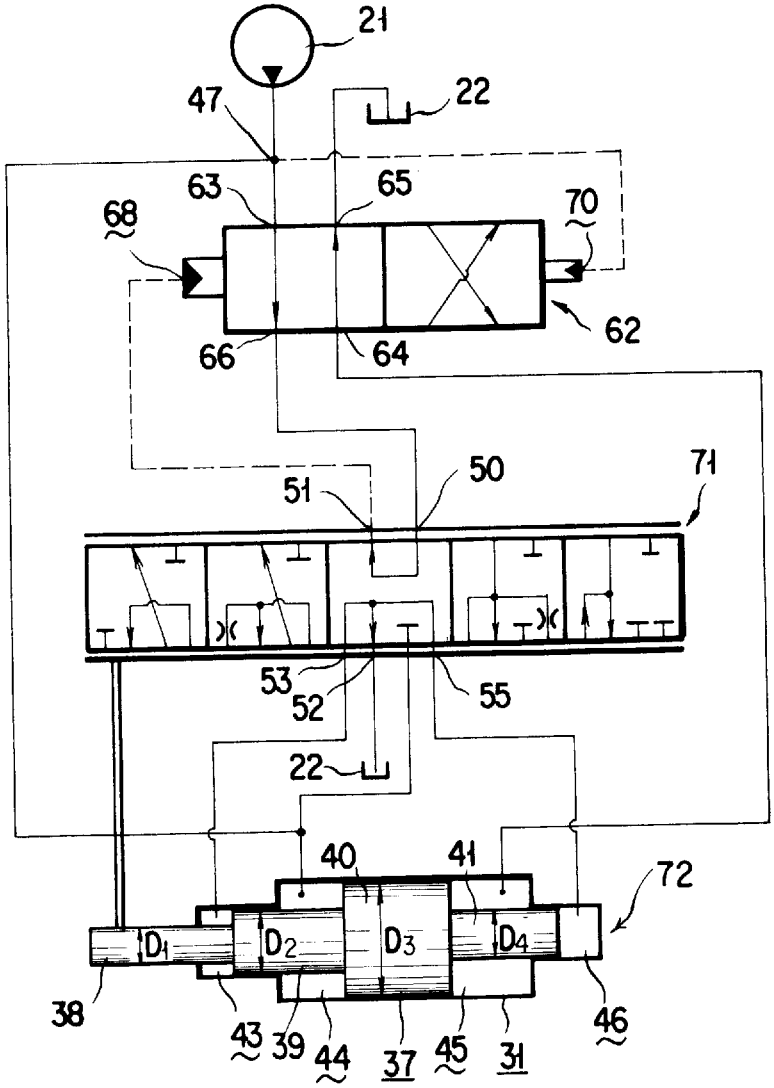
FIG. 15 is an explanatory view that diagrammatically shows the above mentioned second embodiment of the present invention.

The above mentioned vibration generating apparatus (the second embodiment) is represented in a circuit diagram as shown in FIG. 15, in which the said piston 37 itself constitutes a servo valve 71 whereas the said cylindrical bore 31 and the said piston 37 together constitute a cylinder assembly 72. In other words, the basic construction of the said cylinder assembly 72, the said switching valve 62 and the said servo valve 71 here are structurally identical to the said cylinder assembly 6, the said switching valve 9 and the said servo valve 19 in the previously mentioned first embodiment.

An explanation will now be given with respect to the operation of the above mentioned second embodiment of the present invention.

When the said first port 47 is supplied with a pressure fluid from a state as shown in FIGS. 14 and 15, it can be seen that the pressure fluid will flow into the said first pressure receiving chamber 44, the pressure fluid in the said second pressure receiving chamber 45 will flow from the said switching valve 62 through the drain port 52 into the said tank, and the pressure fluid in the said second buffer chamber 46 will flow from the said axial bore 54 and the said second recess 55 through the said drain port 52 into the said tank. The said piston will then be moved in one direction (rightwards).

It should be noted at this point that the said first buffer chamber 43 is then designed to suck a pressure fluid of the said tank through the said first recess 53.

Figure 16:
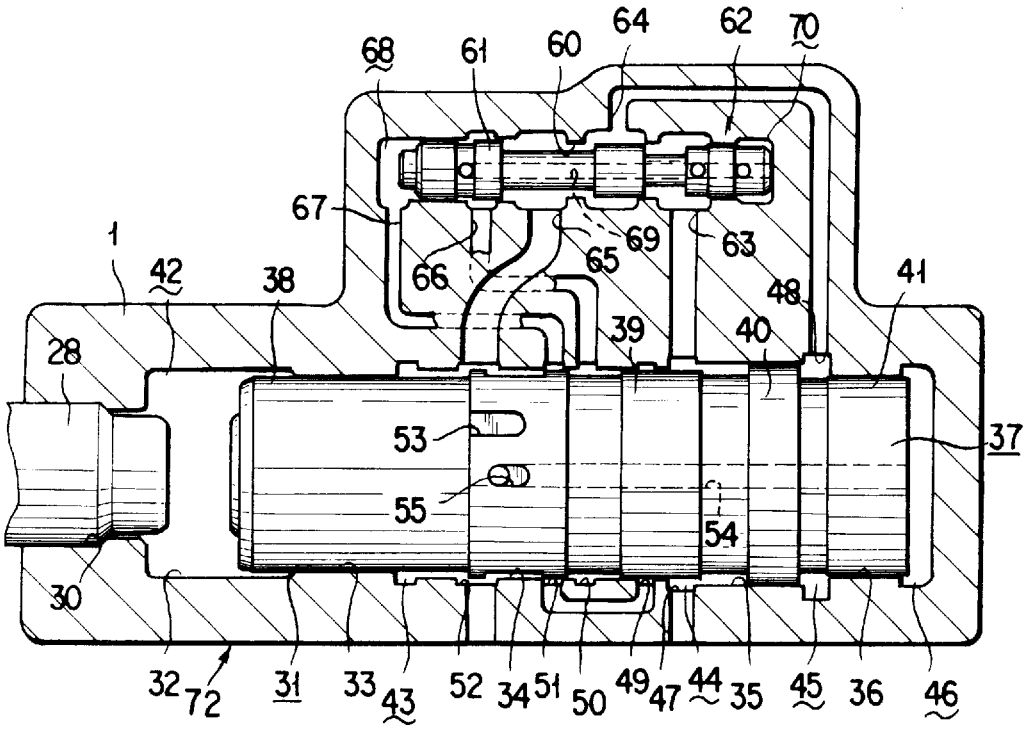
FIG. 16 is an explanatory view that shows an operation of the above mentioned second embodiment of the present invention.
Figure 17:
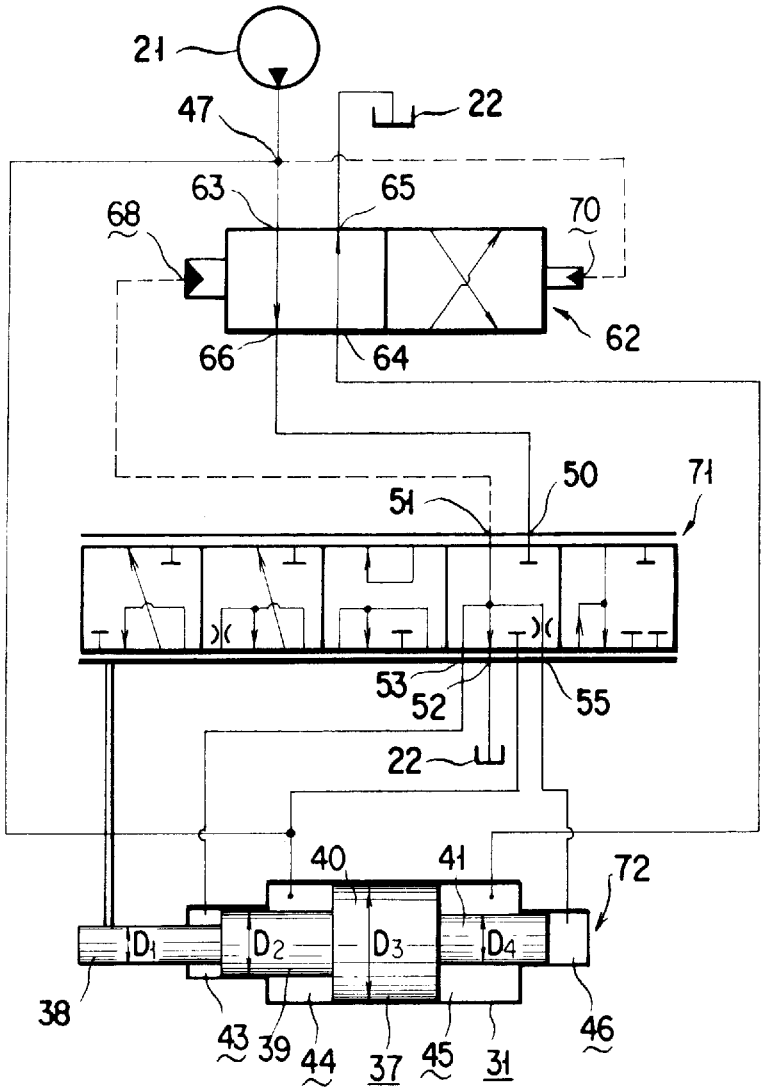
FIG. 17 is an explanatory view that shows an operation of the above mentioned second embodiment of the present invention.

In this instance, it can be seen that the area of opening of the said second recess 55 to the said drain port 52 is, as shown in FIGS. 16 and 17, reduced in a sequence in proportion to the movement of the said piston 37 in the said one direction. As a result, a flow of the pressure fluid that has been sealed in the said second buffer chamber 46 will be throttled in proportion to the movement of the said piston 37 in the said one direction. And, the pressure thereof will be elevated in a sequence to effect a braking of the said piston 37.

Figure 18:
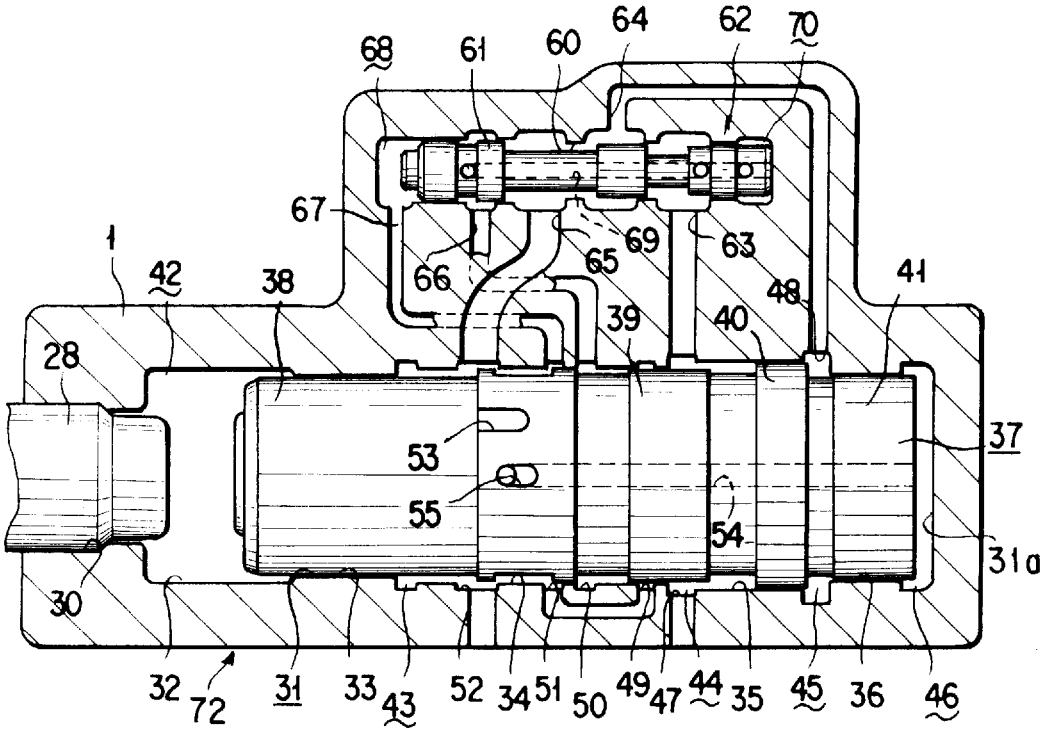
FIG. 18 is an explanatory view that shows an operation of the above mentioned second embodiment of the present invention.
Figure 19:
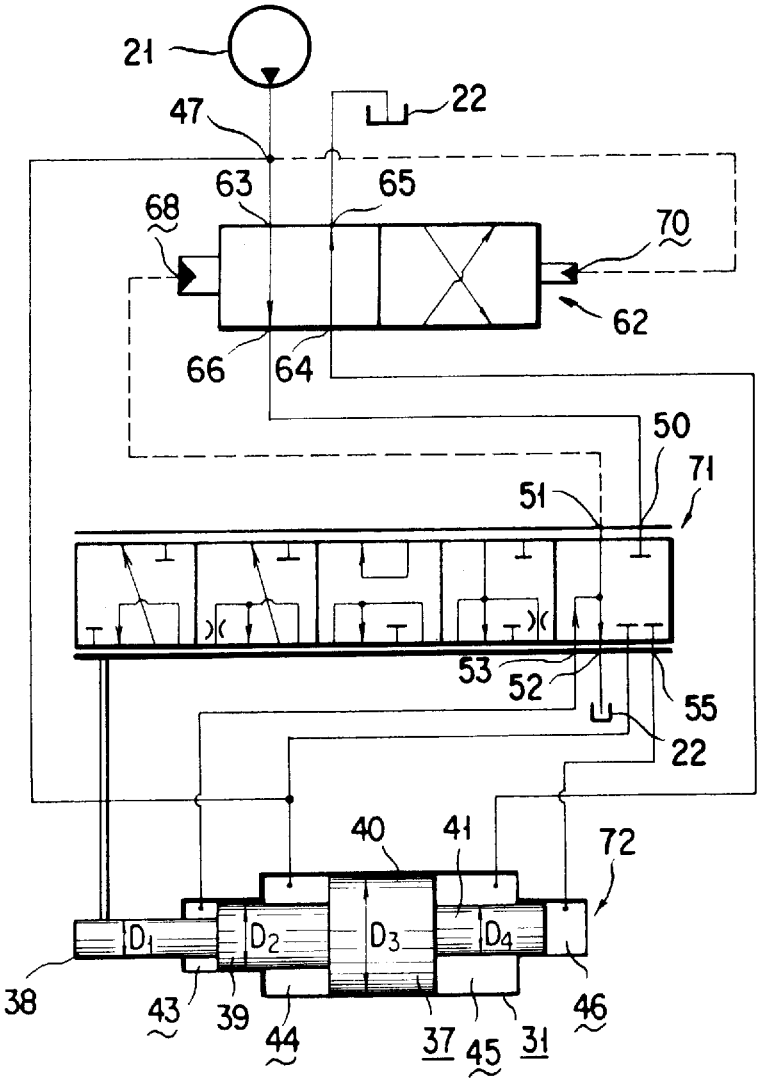
FIG. 19 is an explanatory view that shows an operation of the above mentioned second embodiment of the present invention.

Then, if the communication of the said second recess 55 with the said drain port 52 is blocked as shown in FIGS. 18 and 19, the said piston 37 will cease moving so that it may not collide with the one end surface 31*a* of the said cylindrical bore 31.

Figure 20:
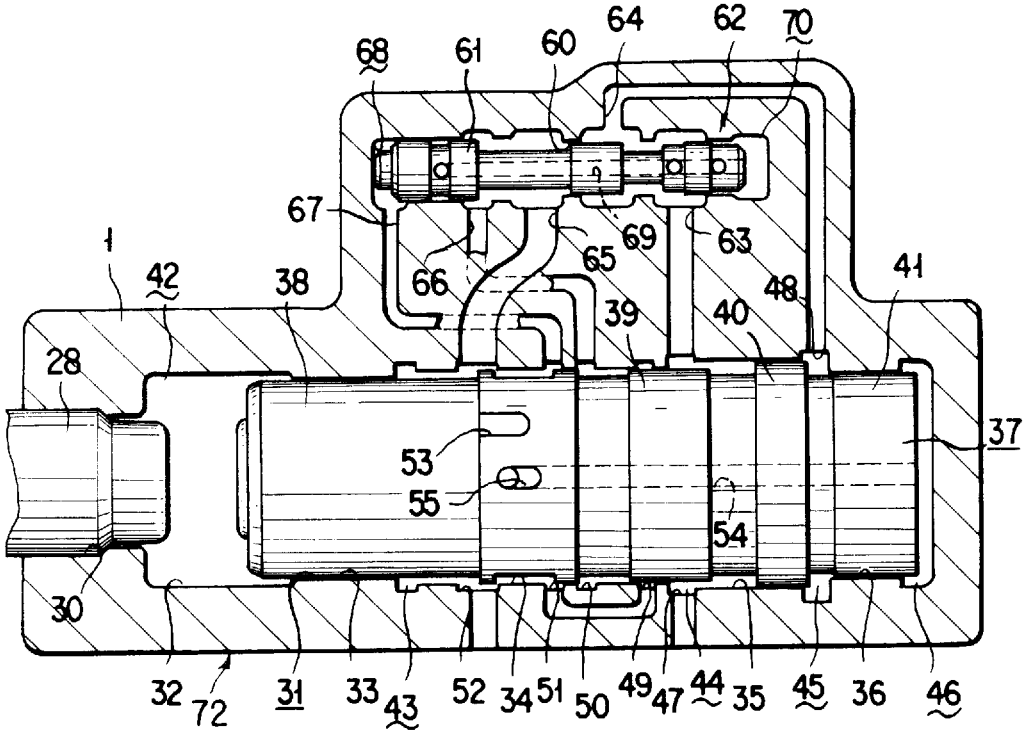
FIG. 20 is an explanatory view that shows an operation of the above mentioned second embodiment of the present invention.
Figure 21:
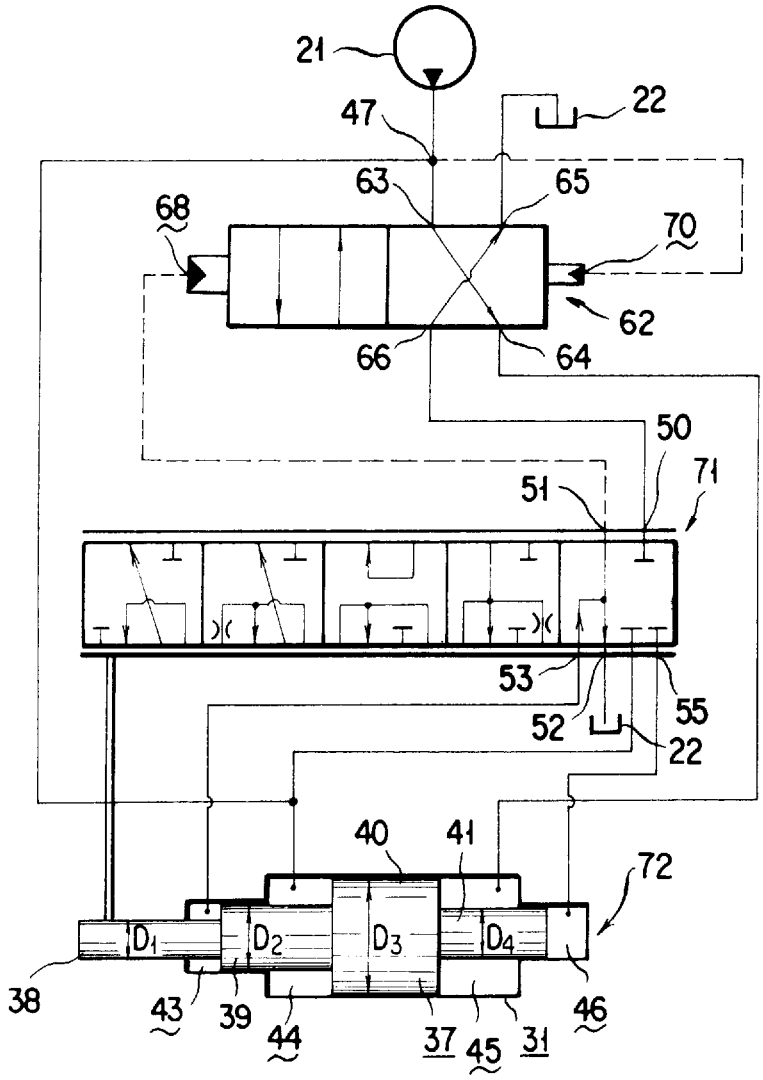
FIG. 21 is an explanatory view that shows an operation of the above mentioned second embodiment of the present invention.

At the same time, the communication between the said fourth port 50 and the said fifth port 51 will be blocked by the said piston 57 while the said fifth port 51 will be allowed to communicate with the said drain port 52, thus permitting the pressure fluid within the said first pressure chamber 68 to be discharged into the said tank. As a result, as shown in FIGS. 20 and 21, the said spool 62 in the said switching valve 62 will be moved leftwards with the pressure fluid within the said second pressure chamber 70 to establish the communication between the said sixth port 63 and the said seventh port 64 while blocking the communication between the said seventh port 64 and the said eighth port 65.

This will allow a pressure fluid to flow into the said second pressure receiving chamber 45 to move the said piston in the said other direction (leftwards). At this time, a force with which the said piston 37 may be moved in the said other direction will also be acted upon under the pressure of a fluid sealed within the said second buffer chamber 46.

In other words, since the said second pressure receiving chamber 45 for the said piston 37 is sized to be greater in pressure receiving area than the said first pressure receiving chamber 44 therefor, the said piston 37 will be moved in the said other direction due to a difference in pressure if the said first and second pressure receiving chambers 44 and 45 is supplied with a pressure fluid.

Figure 22:
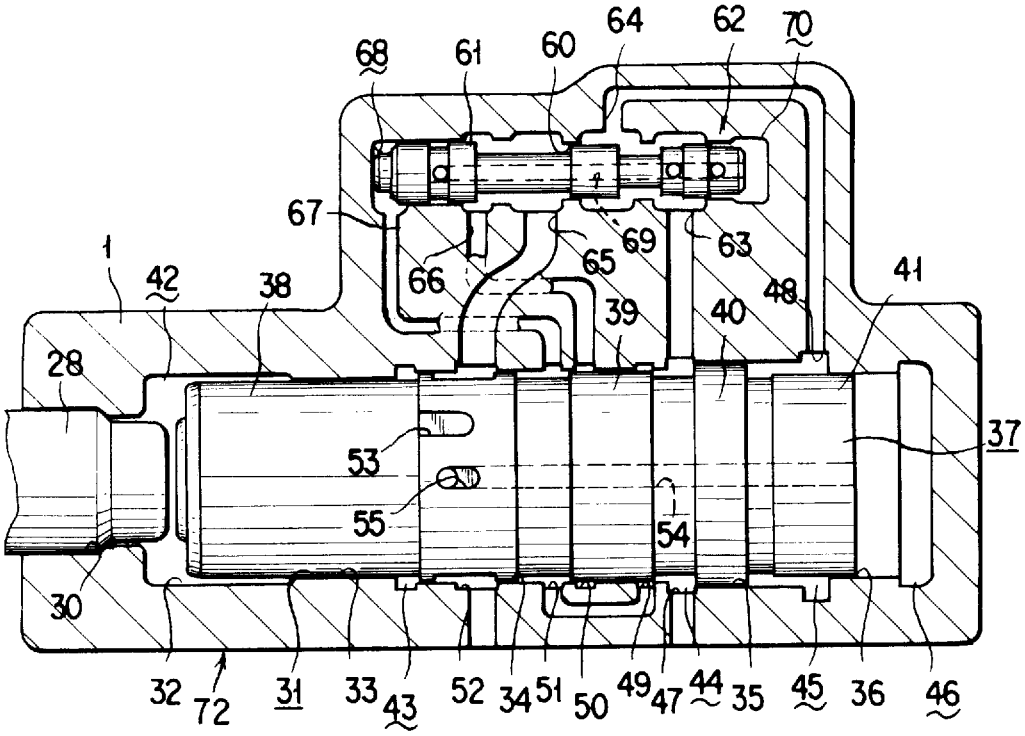
FIG. 22 is an explanatory view that shows an operation of the above mentioned second embodiment of the present invention.
Figure 23:
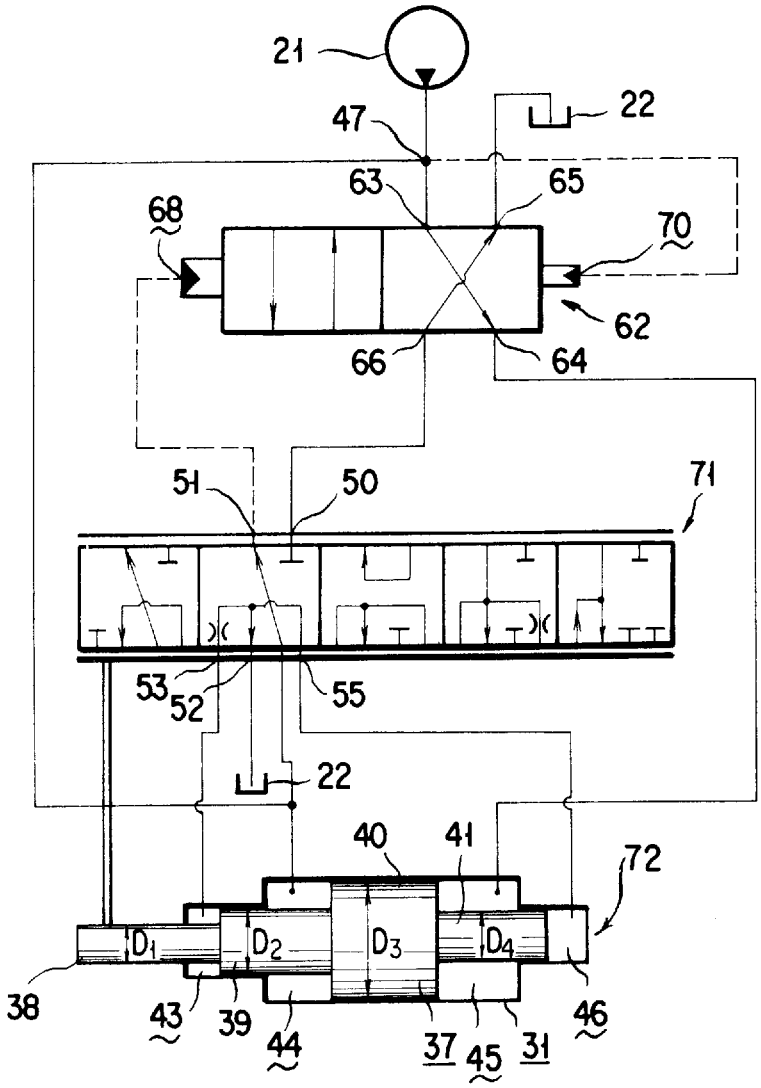
FIG. 23 is an explanatory view that shows an operation of the above mentioned second embodiment of the present invention.

In this instance, it can be seen that the area of opening of the said first recess 53 to the said drain port 52 is, as shown in FIGS. 22 and 23, reduced in a sequence in proportion to the movement of the said piston 37 in the said other direction. As a result, a flow of the pressure fluid that has been sealed in the said first buffer chamber 43 will be throttled in proportion to the movement of the said piston 37 in the said other direction. And, the pressure thereof will be elevated in a sequence to effect a braking of the said piston 37.

Figure 24:
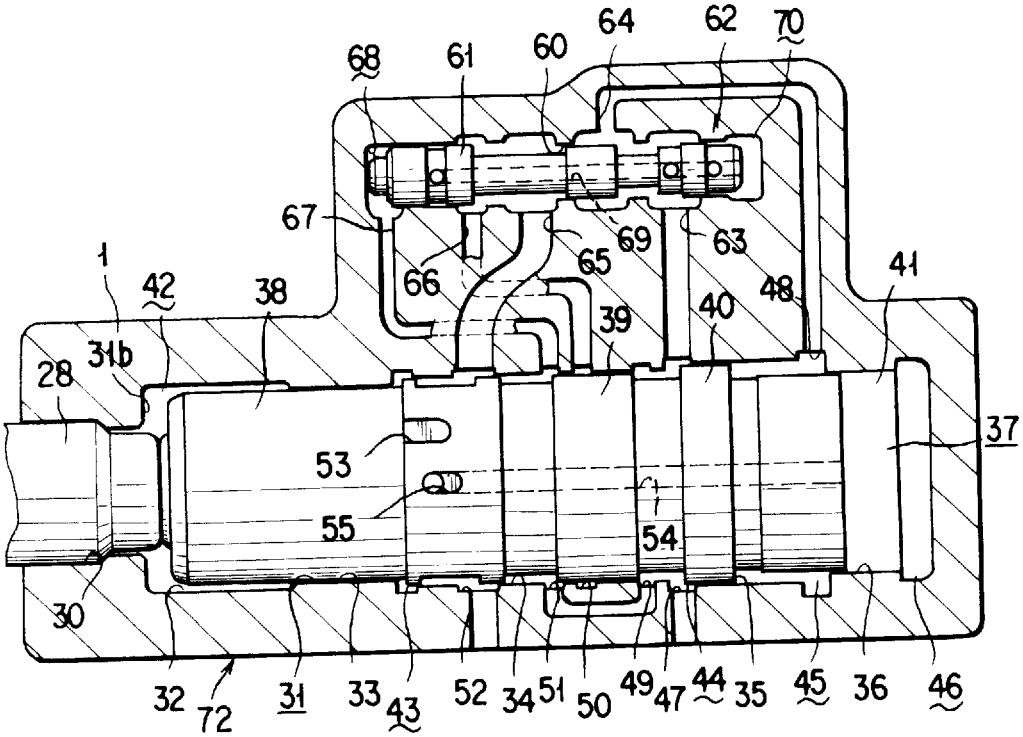
FIG. 24 is an explanatory view that shows an operation of the above mentioned second embodiment of the present invention.
Figure 25:
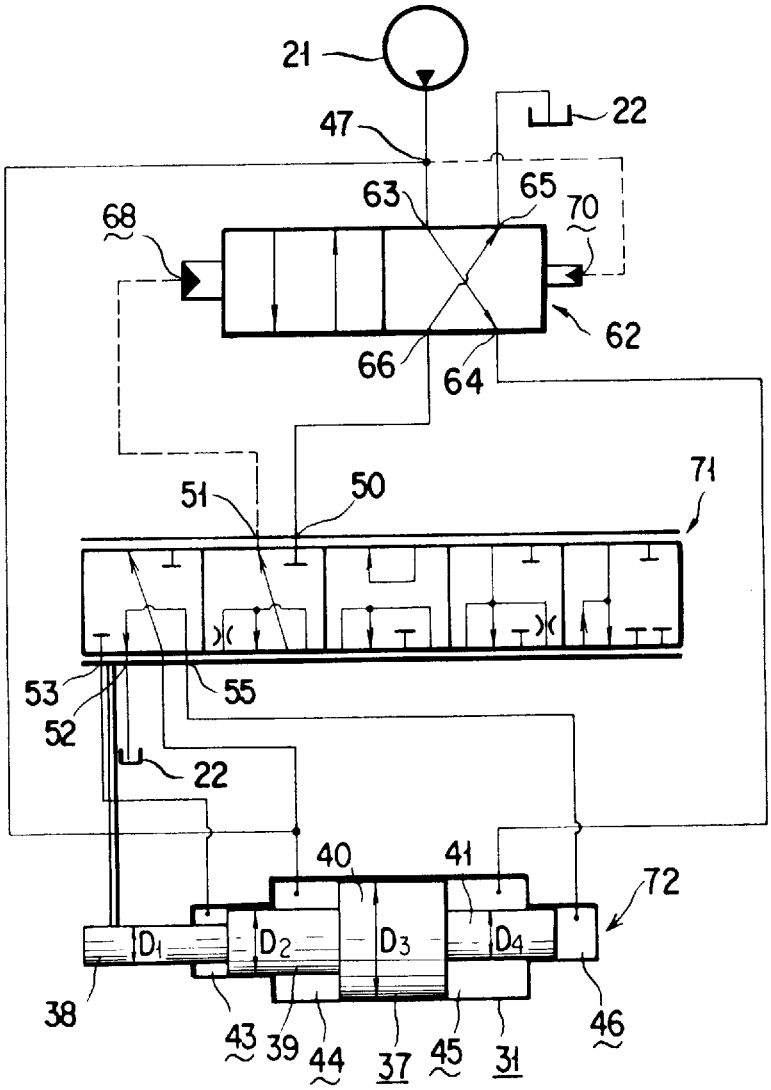
FIG. 25 is an explanatory view that shows an operation of the above mentioned second embodiment of the present invention.

And, as shown in FIGS. 24 and 25, the said piston will collide with the said chisel 28 and, if it is further moved, will cease moving when the communication between the said first recess 53 and the said drain port 52 is blocked so that the said piston 37 may not collide with the other end surface 31*b* of the said cylindrical bore 31.

At the same time, the communication between the said third port 49 and the said fifth port 51 will be established while the communication between the said fifth port 51 and the said drain port 52 will be blocked, thus permitting the said first pressure chamber 68 to be supplied with a pressure fluid to move the said piston 37 rightwards. Then, the said second pressure chamber 70 will be allowed to communicate via the said axial bore 69 with the said drain port 52. Thus, a state as mentioned previously in connection with FIGS. 14 and 15 is brought about. Thereafter, the operation will be repeated to bring about a reciprocating movement of the said piston 37.

With the second embodiment of the present invention constructed as mentioned above, it can be seen that when the said piston 37 is moved in one direction or the other, the pressure within the said second buffer chamber 46 or the said first buffer chamber 43 will be sequentially elevated in proportion to the distance of movement of the said piston 37. Hence, since the said piston 37 ceases moving, before it makes a contact with the one end surface 31*a* or the other end surface 31*b* of the said cylindrical bore 31, there can be no large sound generated and there will be a constant reciprocating movement of the said piston 37 without fail even if the said chisel 28 is not provided.

It can also be seen that by virtue of the fact that it is a reciprocating movement of the said piston 37 that causes the said spool 61 in the said switching valve 62 to be switched, it follows that the said spool 61 in the said switching valve 62 can be accurately positioned to ensure that there will be no false operation of the said piston 37. This feature equally applies here as in the first embodiment of the present invention previously set forth.

An explanation will next be given with respect to a third embodiment of the present invention.

Figure 26:
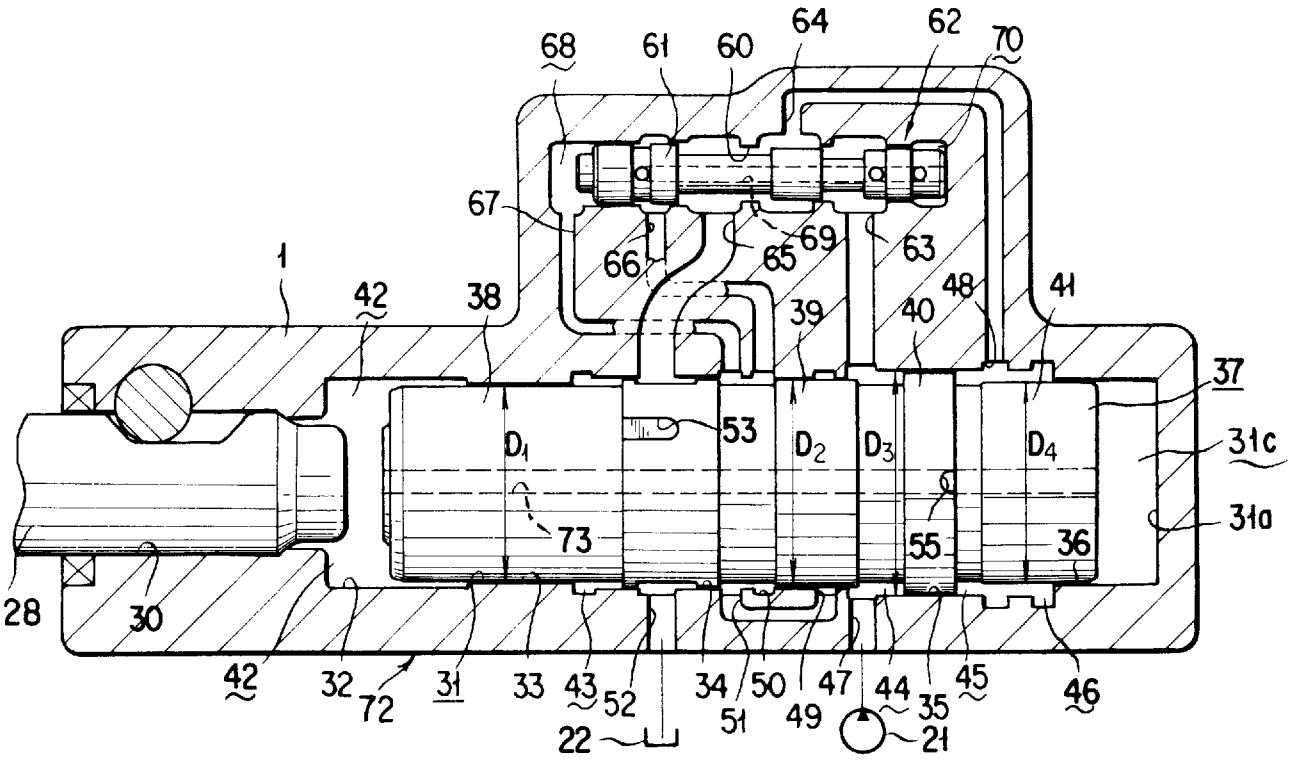
FIG. 26 is a cross sectional view that shows a third embodiment of the vibration generating apparatus according to the present invention.
Figure 27:
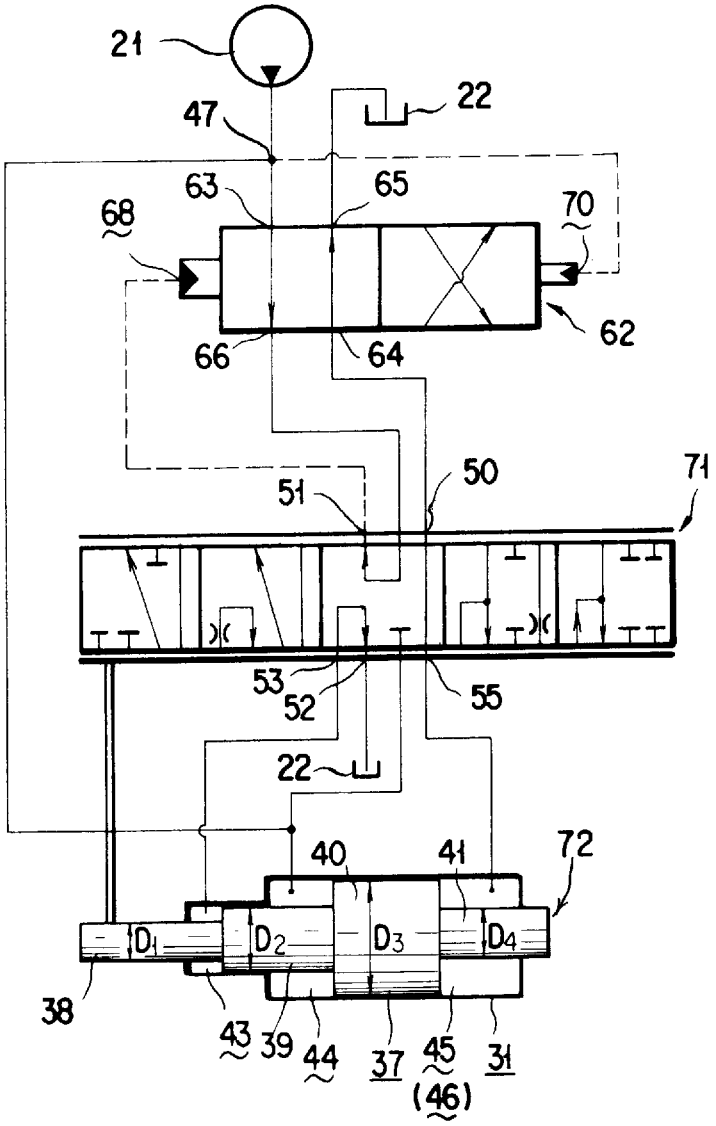
FIG. 27 is an explanatory view that diagrammatically shows the above mentioned third embodiment of the present invention.

As shown in FIGS. 26 and 27, this embodiment is of a construction in which a said second pressure receiving chamber 45 and a said second buffer chamber 46 are arranged to communicate with a said second port 48 and a said third axial portion 40 is formed with a said second recess 55 so that when a said piston 37 is moved in one direction (rightwards), the area of opening of the said second pressure receiving chamber 45 and the said second buffer chamber 46 with the said second port 48 may be sequentially reduced in proportion to the distance of movement of the said piston 37.

While the operation in this case is identical to that of the vibration generating apparatus (the second embodiment) previously described, it should be noted that in this embodiment a space 31*c* formed between the said piston 37 and the one end surface of a said cylindrical bore 31 is arranged to communicate with a said first pressure receiving chamber 42 through an axial bore 73.

An explanation will next be given with respect to a fourth embodiment of the present invention.

Figure 28:
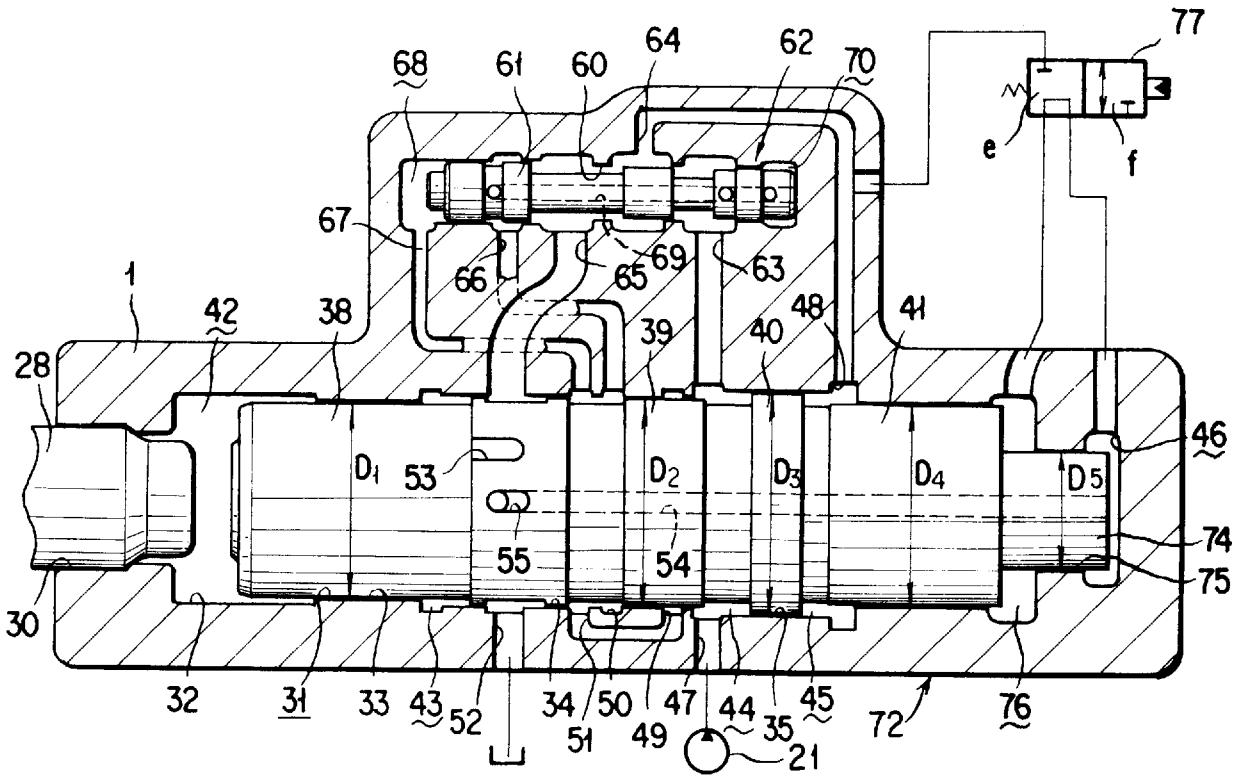
FIG. 28 is a cross sectional view that shows a fourth embodiment of the vibration generating apparatus according to the present invention.
Figure 29:
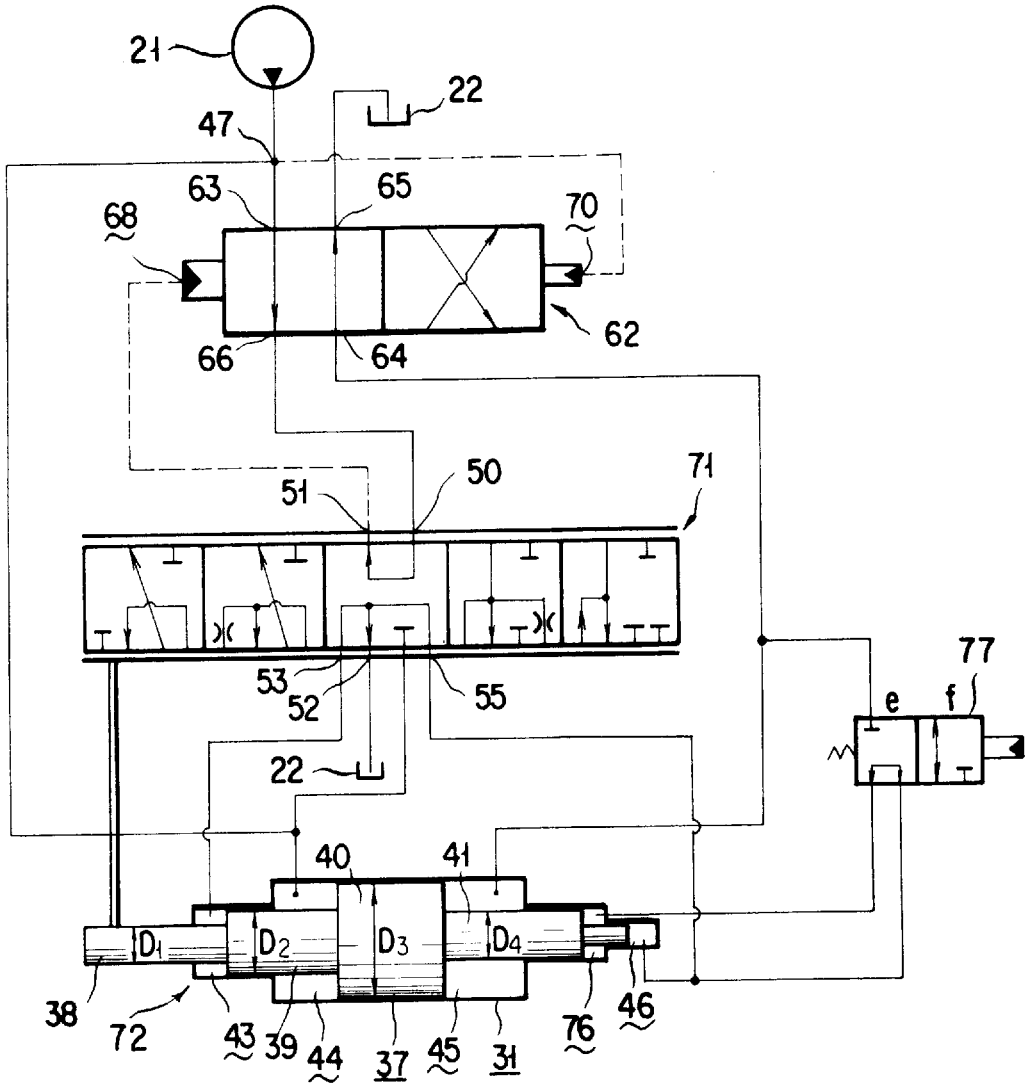
FIG. 29 is an explanatory view that diagrammatically shows the above mentioned fourth embodiment of the present invention.

As shown in FIGS. 28 and 29, this embodiment is of a construction in which a said piston 37 is formed with a fifth axial portion 74, a said cylindrical bore 31 is formed with a sixth bore 75, the said sixth bore 75 has a diameter D5 where the relationship: $D5<D1=D4<D2<D3$ is satisfied, and the said fifth axial portion 74 slidably inserted into the said sixth bore 75 has the diameter of D5, thus defining an auxiliary second pressure receiving chamber 76 that is designed to thrust the said piston 37 in a said other direction.

It can be seen that a communication between the above mentioned auxiliary second pressure receiving 76, an above mentioned second buffer chamber 46 and an above mentioned seventh port 64 may be established and blocked by a volume switching valve 77.

The said volume switching valve 77 is adapted to take its first position e under a spring force and to take its second position f with an external signal exerted by a pilot pressure or by means of a manual lever. While in the said first position e, it will established a communication between the said auxiliary second pressure receiving chamber 76 and the said second buffer chamber 46 while blocking a communication between them and the said seventh port 64. And, while in the said second position f, it will establish a communication between the said auxiliary second pressure receiving chamber 76 and the said seventh port 76 while blocking a communication between them and the said second buffer chamber 46.

Now, an explanation will be given with respect to a crushing operation using the above mentioned fourth embodiment of the present invention.

With a said chisel 28 inserted into a said handling instrument accepting bore 30 and with the said volume switching valve 77 switched to assume its first position e to allow the said auxiliary second pressure receiving chamber 76 to communicate with the said second buffer chamber 46, a crushing operation will likewise be carried out as with the vibration generating apparatus shown in FIGS. 14 and 15. In this instance, the said auxiliary second pressure receiving chamber 76 may constitute a buffer chamber, likewise the said second buffer chamber 46, in a case where the said piston 27 is moved in the said one direction, and the said piston 37 will be moved in the said other direction only under a pressure within the said second pressure receiving chamber 45. As a result, the pressure receiving chamber for displacing the said piston 37 in the said other direction will be made smaller in volume than in the previously mentioned second embodiment and will then accelerate the velocity at which the said piston 37 is moved in the said other direction.

In other terms, if the flow rate of the discharge fluid from the hydraulic pump is constant, it can be seen that the larger the volume of a pressure receiving chamber, the lower will be the rate of movement of the piston 37. Then, the smaller the volume of the pressure receiving chamber, the higher will be the rate of movement of the piston 37. If a crushing operation is to be performed with the chisel 28 impacted, it should be noted that the higher the rate of movement of the piston 37, the better will naturally be the result.

Next, an explanation will be given with respect to the performance of a road rolling operation utilizing a bucket in a hydraulic power shovel.

In the construction mentioned above, wherein the discharge side of a said hydraulic pump 21 is connected to either an extension chamber or a retraction chamber in a bucket cylinder of the hydraulic power shovel (not shown), the said volume switching valve 77 is set to assume its second position f to allow the said auxiliary second pressure receiving chamber 76 to communicate with the said seventh port 64, and the pressure fluid within the said auxiliary second pressure receiving chamber is also used to move the said piston 37 in the said other direction, there will be brought about a reciprocating movement of the said piston 37.

This will cause the volume of a pressure receiving chamber for displacing the said piston 37 in the said other direction to be increased and the rate of movement of the said piston 37 to be lowered. This will in turn cause the volume of the above mentioned pressure receiving chamber and the pressure (in amplitude) at the said first port 47 or in other words the pump pressure to change largely when the movement of the said piston 37 is switched from one direction to the other.

Stated otherwise, the pressure at the said first port 47 will be elevated at the instant at which the said piston 37 that has been moved in one direction is halted and will, thereafter when it is again moved in the other direction, be suddenly lowered since the pump pressure fluid is then caused to flow into an enlarged volume, and it will subsequently be elevated again. It follows, therefore, that the pressure of the said hydraulic pump 21 will be altered largely and cyclically when the above mentioned construction is adopted.

If the pressure of the said hydraulic pump 21 are altered largely and cyclically in this manner, the pressure within the extension or retraction chamber in the bucket cylinder will be altered largely and cyclically. Since the bucket cylinder output is finely extended and retracted, there results a favorable vibration of the bucket to enable a desired road rolling operation to be carried out.

For connecting and disconnecting the discharge side of the hydraulic pump 21 to and from the extension side chamber or the retraction side chamber of the bucket cylinder, it should be noted that there can be provided a switching valve, separately of a bucket directional control valve for supplying the extension side chamber or the retraction side chamber of the bucket cylinder with a pressure fluid so that with the said switching valve set in a communication position, the connection may be achieved and with the said switching valve set in a blocking position, the disconnection may be selected.

As set forth in the foregoing description, according to the present invention, in the said first general aspect thereof, it can be seen that a movement of the said piston 3 in the said cylinder assembly 6 will cause the said first pressure chamber 13 in the switching valve 9 to communicate with the said fluid pressure source and the said tank alternately. Accordingly, when the said switching valve 9 takes the said second position to supply the said second pressure chamber 14 with the pressure fluid so that the said piston 3 may be moved in the said other direction, it can be seen that the said first pressure chamber 13 will be allowed to communicate with a drain outlet; therefore, there will be no pressure generated in the said first pressure chamber 13.

Accordingly, there may be no possibility for the said switching valve to take the said first position while the said piston 3 is being moved in the said other direction. Hence, it ensues that the said piston will be moved without suffering from any false operation whatsoever.

Also, according to the present invention, in the said second general aspect thereof, it can be seen that while the said piston 37 is being moved in the said one or the said other direction, its velocity of movement will be slowed down sequentially and since it can, prior to its arrival at a stroke end, be stopped with the pressure fluid within the said second buffer chamber 46 or the said first buffer chamber 43, there will be no large sound of impact generated and the said piston may be moved in the said one and the said other directions alternately without fail if a chisel 28 is not provided.

It can also be seen that the said piston 37 may suffer from no false operation whatsoever since it is by a movement thereof which the said servo valve 71 or said switching valve 62 is switched.

According to the present invention, in the said third and fourth general aspects thereof, it can further be seen that while the said piston 37 is being moved in the said one or the said other direction, its velocity of movement will be slowed down in a sequence; hence there could be no large sound of impact generated.

It can still further be seen that if the said second pressure receiving chamber 45 is reduced in volume, it will be enabled for the said piston 37 to be moved at an increased velocity, thus making an impact by a chisel appropriate and that if the said pressure receiving chamber 45 is increased in volume, a hydraulic pump for supplying the said second pressure chamber 45 with the pressure fluid will be increased in its pressure change to enable a high pressure and a low pressure to be generated alternately. Thus, using such a high pressure and such a low pressure, it will become possible to vibrate a bucket cylinder or the like.

According to the present invention, in the fifth general aspect thereof, it can also be seen that the attachment of a handling instrument to a piston 3, 37 will enable the said handling instrument to be impacted by the said piston 3, 37. The handling instrument, if constituted by a chisel, permits a desired crushing operation to be carried out, and, if constituted by a rolling plate, allows a desired road rolling operation to be performed.

While the present invention has hereinbefore been set forth with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all the equivalents thereof.

What is claimed is:

1. A vibration generating apparatus, comprising:

a cylinder assembly having a cylinder and a piston slidably inserted in a cylindrical bore of said cylinder for defining a first pressure receiving chamber with a small pressure receiving area and a second pressure receiving chamber with a large pressure receiving area, said piston being movable in one direction with a pressure fluid within said first pressure receiving chamber and in the other direction under a difference in pressure based on a difference in pressure receiving area between said first pressure receiving chamber and said second pressure receiving chamber;

a switching valve having a first pressure chamber with a large diameter, a second pressure chamber with a small diameter, a pump port, an auxiliary port, a principal port and a tank port and being adapted to take a first position under a pressure within said first pressure chamber and to take a second position under a pressure within said second pressure chamber, said first position being taken to allow said pump port to communicate with said auxiliary port and to allow said principal port to communicate with said tank port, said second position being taken to allow said pump port to communicate with said principal port and to allow said auxiliary port to communicate with said tank port; and a servo valve responsive to a movement of said piston for establishing a communication of said first pressure chamber with a fluid pressure source or a tank, each of said first pressure receiving chamber and said second pressure chamber having a communication with said fluid pressure source, said second pressure receiving chamber having a communication with said principal port.

2. A vibration generating apparatus, as set forth claim 1, in which said cylinder assembly, said switching valve and said servo valve are incorporated in a unit body, and said unit body has a handling instrument detachably attached thereto in opposition to said piston so that said handling instrument may be impacted when said piston is moved in said other direction.

3. A vibration generating apparatus, comprising:

a cylinder assembly having a cylinder and a piston slidably inserted in a cylindrical bore of said cylinder for defining a first pressure receiving chamber with a small pressure receiving area, a second pressure receiving chamber with a large pressure receiving area, a first buffer chamber and a second buffer chamber, said piston being movable in one direction with a pressure fluid within said first pressure receiving chamber and in the other direction under a difference in pressure based on a difference in pressure receiving area between said first pressure receiving chamber and said second pressure receiving chamber, said second buffer chamber being responsive to a movement of said piston in said one direction for reducing its volume, said first buffer chamber being responsive to a movement of said piston in said other direction for reducing its volume;

a switching valve having a first pressure chamber with a large diameter, a second pressure chamber with a small diameter, a pump port, an auxiliary port, a principal port and a tank port and being adapted to take a first position under a pressure within said first pressure chamber and to take a second position under a pressure within said second pressure chamber, said first position being taken to allow said pump port to communicate with said auxiliary port and to allow said principal port to communicate with said tank port, said second position being taken to allow said pump port to communicate with said principal port and to allow said auxiliary port to communicate with said tank port; and a servo valve responsive to a movement of said piston for establishing a communication of said first pressure chamber with a fluid pressure source or a tank, said servo valve being also responsive to a movement of said piston in said one direction for permitting said first buffer chamber to communicate with said tank while reducing an area of communication between said second buffer chamber and said tank in a sequence and responsive to a movement of said piston in said other direction for permitting said second buffer chamber to communicate with said tank while reducing an area of communication between said first buffer chamber and said tank in a sequence, each of said first pressure receiving chamber and said second pressure chamber having a communication with said fluid pressure source, said second pressure receiving chamber having a communication with said principal port, said apparatus being adapted to block a communication between said second buffer chamber and said tank or a communication between said first buffer chamber and said tank, prior to an arrival of said piston at a stroke end in said one direction or in said other direction.

4. A vibration generating apparatus, as set forth in claim 3, in which said cylinder assembly, said switching valve and said servo valve are incorporated in a unit body, and said unit body has a handling instrument detachably attached thereto in opposition to said piston so that said handling instrument may be impacted when said piston is moved in said other direction.

5. A vibration generating apparatus, comprising:

a cylinder assembly having a cylinder and a piston slidably inserted in a cylindrical bore of said cylinder for defining a first pressure receiving chamber with a small pressure receiving area, a first buffer chamber, a second pressure receiving chamber with a large pressure receiving area, and a second buffer chamber, said second pressure receiving chamber also serving as a second buffer chamber, said piston being movable in one direction with a pressure fluid within said first pressure receiving chamber and in the other direction under a difference in pressure based on a difference in pressure receiving area between said first pressure receiving chamber and said second pressure receiving chamber, said second pressure receiving chamber being responsive to a movement of said piston in said one direction for reducing its volume, said first buffer chamber being responsive to a movement of said piston in said other direction for reducing its volume;

a switching valve having a first pressure chamber with a large diameter, a second pressure chamber with a small diameter, a pump port, an auxiliary port, a principal port and a tank port and being adapted to take a first position under a pressure within said first pressure chamber and to take a second position under a pressure within said second pressure chamber, said first position being taken to allow said pump port to communicate with said auxiliary port and to allow said principal port to communicate with said tank port, said second position being taken to allow said pump port to communicate with said principal port and to allow said auxiliary port to communicate with said tank port; and a servo valve responsive to a movement of said piston for establishing a communication of said first pressure chamber with a fluid pressure source or a tank, said servo valve being also responsive to a movement of said piston in said one direction for permitting said first buffer chamber to communicate with said tank while reducing an area of communication between said second buffer chamber and said tank in a sequence and responsive to a movement of said piston in said other direction for permitting said second buffer chamber to communicate with said tank while reducing an area of communication between said first buffer chamber and said tank in a sequence, each of said first pressure receiving chamber and said second pressure chamber having a communication with said fluid pressure source, said apparatus being adapted to block a communication between said second pressure receiving chamber and said tank or a communication between said first buffer chamber and said tank, prior to an arrival of said piston at a stroke end in said one direction or in said other direction.

6. A vibration generating apparatus, as set forth in claim 5, in which said cylinder assembly, said switching valve and said servo valve are incorporated in a unit body, and said unit body has a handling instrument detachably attached thereto in opposition to said piston so that said chisel may be impacted when said piston is moved in said other direction.

7. A vibration generating apparatus, comprising:

a cylinder assembly having a cylinder and a piston slidably inserted in a cylindrical bore of said cylinder for defining a first pressure receiving chamber with a small pressure receiving area, a second pressure receiving chamber with a large pressure receiving area, a first buffer chamber and a second buffer chamber, said piston being movable in one direction with a pressure fluid within said first pressure receiving chamber and in the other direction under a difference in pressure based on a difference in pressure receiving area between said first pressure receiving chamber and said second pressure receiving chamber, said second buffer chamber being responsive to a movement of said piston in said one direction for reducing its volume, said first buffer chamber being responsive to a movement of said piston in said other direction for reducing its volume;

a switching valve having a first pressure chamber with a large diameter, a second pressure chamber with a small diameter, a pump port, an auxiliary port, a principal port and a tank port and being adapted to take a first position under a pressure within said first pressure chamber and to take a second position under a pressure within said second pressure chamber, said first position being taken to allow said pump port to communicate with said auxiliary port and to allow said principal port to communicate with said tank port, said second position being taken to allow said pump port to communicate with said principal port and to allow said auxiliary port to communicate with said tank port;

a servo valve responsive to a movement of said piston for establishing a communication of said first pressure chamber with a fluid pressure source or a tank, said servo valve being also responsive to a movement of said piston in said one direction for permitting said first buffer chamber to communicate with said tank while reducing an area of communication between said second buffer chamber and said tank in a sequence and responsive to a movement of said piston in said other direction for permitting said second buffer chamber to communicate with said tank while reducing an area of communication between said first buffer chamber and said tank in a sequence; and a volume switching means for increasing and decreasing the volume of said second pressure receiving chamber, each of said first pressure receiving chamber and said second pressure chamber having a communication with said fluid pressure source, said second pressure receiving chamber having a communication with said principal port, said apparatus being adapted to block a communication between said second buffer chamber and said tank or a communication between said first buffer chamber and said tank, prior to an arrival of said piston at a stroke end in said one direction or in said other direction.

8. A vibration generating apparatus, as set forth in claim 7, in which said cylinder assembly, said switching valve and said servo valve are incorporated in a unit body, and said unit body has a handling instrument detachably attached thereto in opposition to said piston so that said handling instrument may be impacted when said piston is moved in said other direction.

9. A vibration generating apparatus, as set forth in claim 7, in which said volume switching means comprises an auxiliary second pressure receiving chamber disposed in said cylinder assembly, and a volume switching valve for permitting said auxiliary second pressure receiving chamber to communicate with said second buffer chamber or said said second pressure chamber.

10. A vibration generating apparatus, as set forth in claim 9, in which said cylinder assembly, said switching valve and said servo valve are incorporated in a unit body, and said unit body has a handling instrument detachably attached thereto in opposition to said piston so that said handling instrument may be impacted when said piston is moved in said other direction.

* * * * *